US012527365B2

(12) United States Patent
Friedman et al.

(10) Patent No.: US 12,527,365 B2
(45) Date of Patent: Jan. 20, 2026

(54) ADJUSTABLE FIT TACTICAL VEST

(71) Applicant: Agilite Ergonomics (E.B.) Ltd., Holon (IL)

(72) Inventors: Lev Israel Friedman, Ramat Gan (IL); Tomer Van Der Kooij, Breda (NL)

(73) Assignee: AGILITE ERGONOMICS (E.B.) LTD., Holon (IL)

( * ) Notice: Subject to any disclaimer, the term of this patent is extended or adjusted under 35 U.S.C. 154(b) by 38 days.

(21) Appl. No.: 18/238,631

(22) Filed: Aug. 28, 2023

(65) Prior Publication Data

US 2025/0072532 A1 Mar. 6, 2025

(51) Int. Cl.

| | |
|---|---|
| ***A41D 1/00*** | (2018.01) |
| ***A41D 1/04*** | (2006.01) |
| ***F41H 1/02*** | (2006.01) |

(52) U.S. Cl.

CPC ..... *A41D 1/04* (2013.01); *F41H 1/02* (2013.01); *A41D 2300/32* (2013.01); *A41D 2400/48* (2013.01)

(58) Field of Classification Search

CPC ..... A41D 1/04; A41D 2300/32

See application file for complete search history.

(56) References Cited

U.S. PATENT DOCUMENTS 3,968,803 A * 7/1976 Hyman ..... A61F 13/145 602/61
4,697,285 A * 10/1987 Sylvester ..... F41H 1/02 2/2.5
6,733,483 B2 * 5/2004 Raufman ..... A61F 13/5633 604/385.03
6,769,137 B2 * 8/2004 D'Annunzio ..... F41H 1/02 2/102
7,047,570 B2 * 5/2006 Johnson ..... F41H 1/02 2/102
7,243,376 B2 * 7/2007 Johnson ..... F41H 1/02 2/102
7,424,748 B1 * 9/2008 McDunn ..... F41H 1/02 2/2.5
8,490,212 B1 * 7/2013 Asher ..... A41D 1/04 2/2.5
9,222,757 B2 12/2015 Seuk
9,801,458 B2 * 10/2017 Storms, Jr. ..... F41H 1/02
9,808,369 B1 * 11/2017 Gaylord ..... A61F 5/02
9,901,127 B2 * 2/2018 LeMarbe ..... A41D 13/0556
10,584,942 B2 * 3/2020 Wellman ..... F41H 5/013
(Continued)

*Primary Examiner* — Richale L Quinn
(74) *Attorney, Agent, or Firm* — Merchant & Gould P.C.

(57) ABSTRACT

In one embodiment, a system for fit adjustment of a tactical vest may include shoulder straps configured to have independently adjustable wearable lengths and to be releasably attachable to a face of a panel of the tactical vest at any of a plurality of potential shoulder strap attachment positions; and a set of reference markings on the face of the panel, each reference marking of the set of reference markings indicating a respective potential shoulder strap attachment position of the plurality of potential shoulder strap attachment positions, wherein the set of reference markings is configured such that releasably attaching each of the shoulder straps to the face of the panel of the tactical vest so that corresponding portions of the shoulder straps align with equivalent reference markings causes the shoulder straps to have an equivalent wearable length.

13 Claims, 28 Drawing Sheets

(56) References Cited

U.S. PATENT DOCUMENTS

| | | | | |
|---|---|---|---|---|
| 10,605,574 | B2 * | 3/2020 | Swan | F41H 5/013 |
| 10,631,584 | B2 * | 4/2020 | LeMarbe | A41D 1/04 |
| 11,041,696 | B2 | 6/2021 | Swan et al. | |
| 11,752,025 | B2 * | 9/2023 | Poker | A61F 5/022 602/19 |
| 12,064,025 | B2 * | 8/2024 | Bonn | A45F 3/14 |
| 2004/0122344 | A1 * | 6/2004 | Nelson | A61F 5/40 602/61 |
| 2007/0142798 | A1 * | 6/2007 | Goodlander | A61F 13/49012 604/361 |
| 2008/0233817 | A1 * | 9/2008 | Meissner | B63C 9/115 441/106 |
| 2010/0168701 | A1 * | 7/2010 | Schmidt | A61F 13/42 604/361 |
| 2010/0222760 | A1 * | 9/2010 | Rinaldi | A61F 13/84 604/385.01 |
| 2011/0214675 | A1 * | 9/2011 | Kost | A61M 16/0497 128/207.17 |
| 2013/0110068 | A1 * | 5/2013 | Nelson | A61F 13/55105 604/385.01 |
| 2016/0089039 | A1 * | 3/2016 | Turturro | B32B 27/36 428/189 |
| 2018/0228664 | A1 * | 8/2018 | Hou | A61F 13/627 |
| 2020/0206548 | A1 * | 7/2020 | Howland | A62B 35/0018 |
| 2020/0253360 | A1 * | 8/2020 | Hahn | H01M 10/6235 |
| 2023/0240383 | A1 * | 8/2023 | Cuervo | A41C 3/0057 450/58 |
| 2024/0057703 | A1 * | 2/2024 | Spataro | A41F 9/025 |

* cited by examiner

ADJUSTABLE FIT TACTICAL VEST

TECHNICAL FIELD

The present invention relates to the field of equipment bearing garments such as tactical vests for sporting, military, law enforcement, and tactical applications. More specifically, the invention pertains to an adjustable fit tactical vest that offers enhanced comfort, mobility, load leveling, and customization options for users.

BACKGROUND

A wide variety of tactical vests are available catering to a range of operational needs and/or preferences. For example, tactical vests can include plate carriers, chest rigs, tactical harnesses, sporting vests, load-bearing vests, concealed carry vests, etc. Often, tactical vests are essential pieces of equipment worn by military personnel, law enforcement officers, and other professionals operating in high-risk environments. These vests play a critical role in equipping a wearer for a tactical engagement by providing them a platform for carrying mission-critical gear and equipment. In addition, some tactical vests can serve as a crucial line of defense offering protection against ballistic threats during tactical engagements.

A tactical vest should be configured to ensure the safety, comfort, and mobility of the wearer. Unfortunately, the current market offerings often fall short of meeting these critical requirements. Many existing systems are designed with fixed sizes and limited adjustability options, resulting in a "one-size-fits-all" approach that fails to accommodate the diverse range of body types and preferences among users. Existing tactical vest adjustable elements are clumsy elements that require laborious efforts (e.g., doffing, adjusting, disassembling, reconfiguring gear, etc.) over multiple attempts to achieve coarse and/or imprecise fit adjustments that are not adaptive.

Consequently, users frequently encounter issues related to poor fit, discomfort, restricted movement, and compromised functionality. Ill-fitting tactical vests can lead to chafing, restricted range of motion, and even fatigue, negatively impacting the performance and effectiveness of those relying on this crucial piece of protective gear. Often relied upon in situations where the consequence of sub-optimal performance is injury or loss of life, these shortcomings pose an unacceptable risk to wearers. Conversely, a well-fitting tactical vest not only enhances individual performance but also contributes to overall mission success. Improved comfort and freedom of movement allow wearers to respond swiftly and effectively, enabling them to perform critical tasks with confidence and precision.

BRIEF DESCRIPTION OF THE DRAWINGS

The embodiments herein may be better understood by referring to the following description in conjunction with the accompanying drawings in which like reference numerals indicate identically or functionally similar elements, of which.

DESCRIPTION OF EXAMPLE EMBODIMENTS

Overview

Figure 1A:
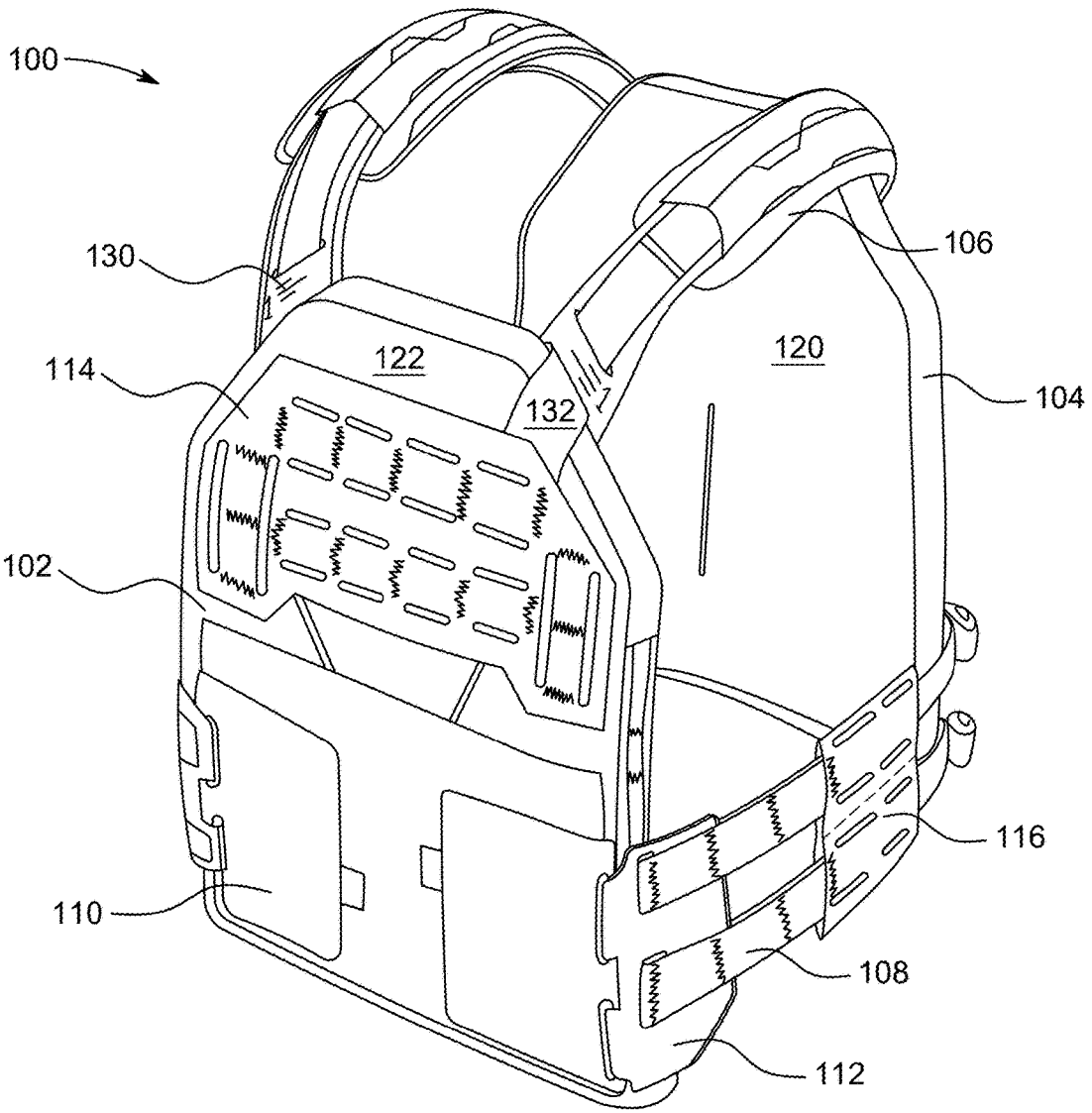
FIGS. 1A-1D illustrate perspective views of an example of an adjustable fit tactical vest.
Figure 1B:
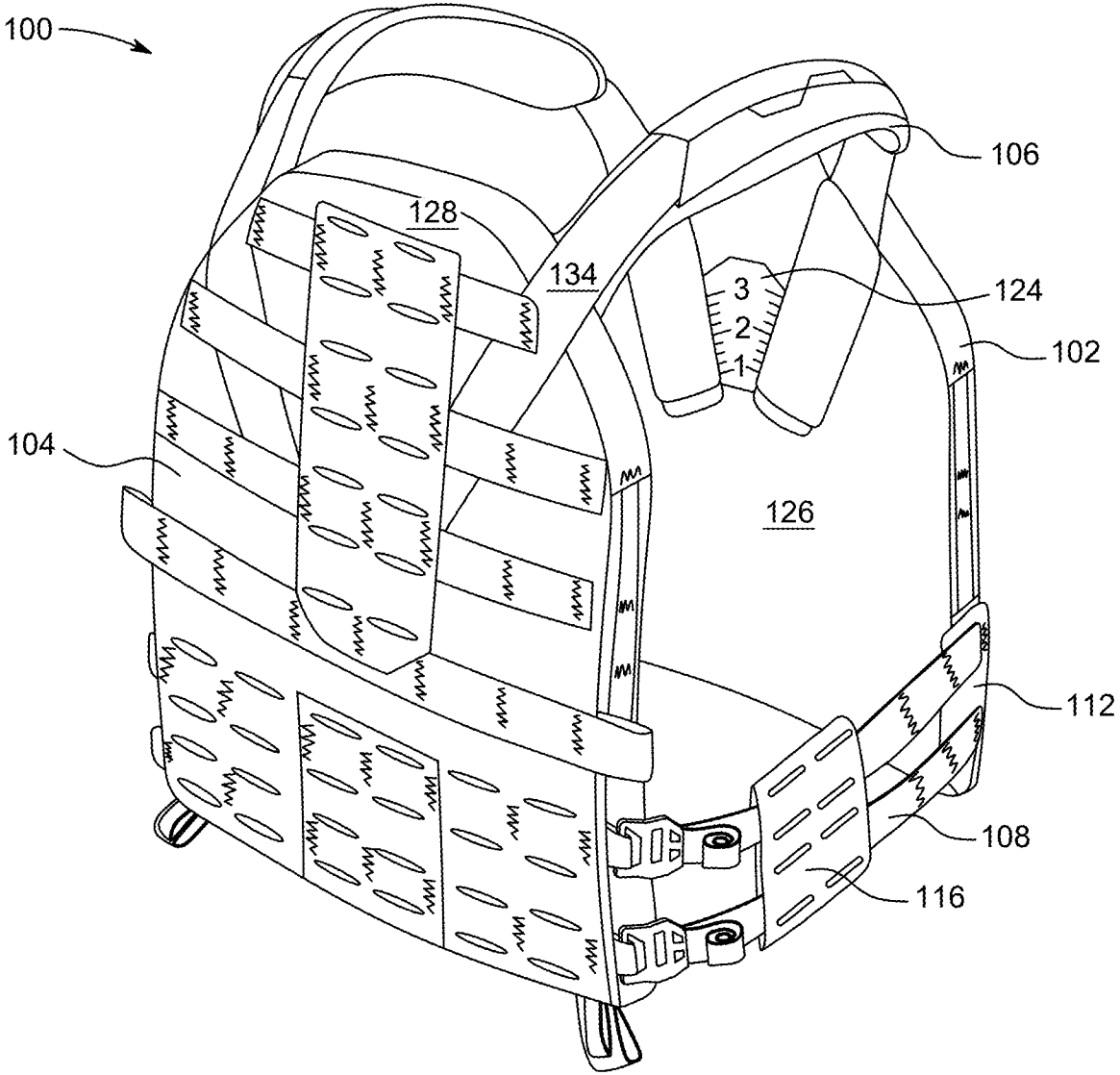
Figure 1C:
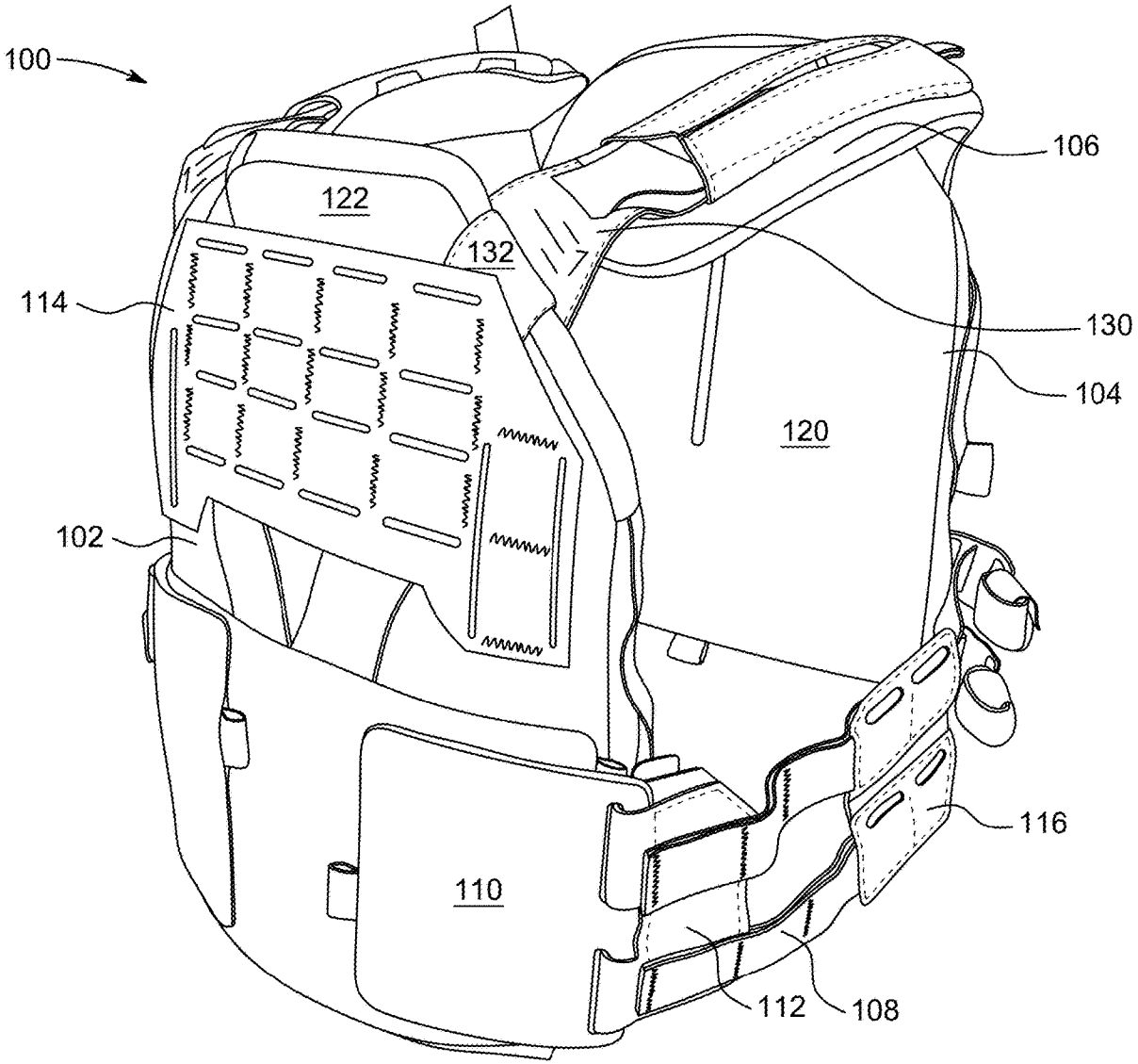
Figure 1D:
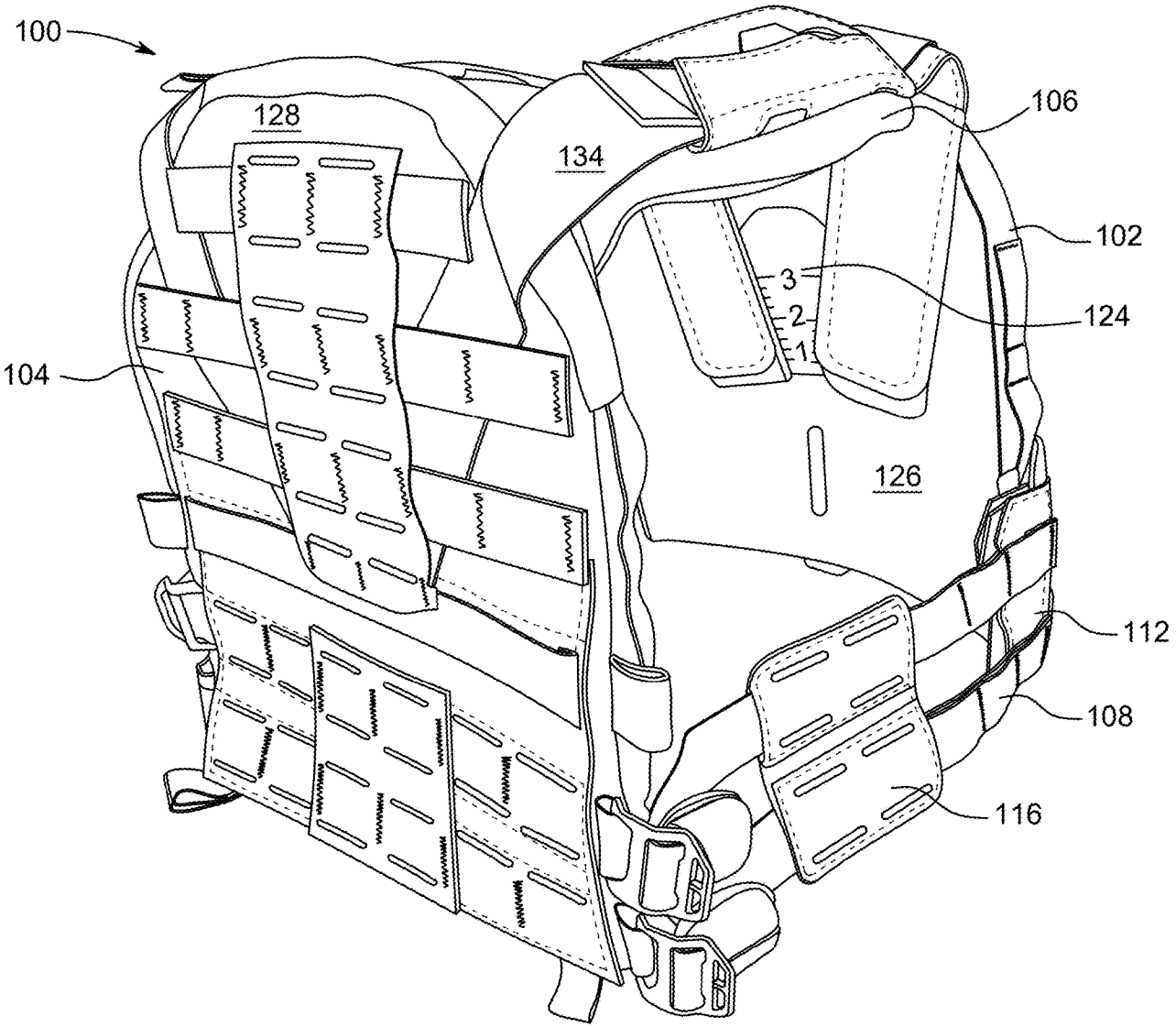

According to one or more embodiments of the disclosure, a system for fit adjustment of a tactical vest may comprise shoulder straps configured to have independently adjustable wearable lengths and to be releasably attachable to a face of a chest panel of the tactical vest or a back panel of the tactical vest at any of a plurality of potential shoulder strap attachment positions; and a set of reference markings on the face of the chest panel or the back panel, each reference marking of the set of reference markings indicating a respective potential shoulder strap attachment position of the plurality of potential shoulder strap attachment positions, wherein the set of reference markings is configured such that releasably attaching each of the shoulder straps to the face of the chest panel of the tactical vest or the back panel of the tactical vest so that corresponding portions of the shoulder straps align with equivalent reference markings causes the shoulder straps to have an equivalent wearable length.

Another embodiment relates to a tactical vest fit adjustment apparatus comprising a first panel including a set of panel reference markings to identify a shoulder strap attachment position among a plurality of potential shoulder strap attachment positions where a shoulder strap is releasably attached to a face of the first panel; and shoulder straps configured to couple the first panel to a second panel across shoulders of a wearer, wherein each of the shoulder straps is configured to have an independently adjustable wearable length dictated by its shoulder strap attachment position and wherein the shoulder straps are configured to have a same wearable length when the shoulder straps are releasably attached to the first panel in alignment with equivalent reference marking of the set of panel reference markings.

Another embodiment relates to a tactical vest, comprising a chest panel comprising an external face and an internal face and having a set of reference markings indicating respective strap attachment positions on the internal face; a back panel; a first strap attached to the chest panel and having a first releasable attachment portion configured to engage a corresponding portion of a third strap; a second strap attached to the back panel and having a second releasable attachment portion configured to engage a corresponding portion of the third strap; the third strap attached to the back panel and having: a chest panel engaging portion configured to releasably attach to the internal face of the chest panel, and a slotted channel portion including a set of channel reference markings corresponding to the set of reference markings indicating the respective strap attachment positions on the internal face of the chest panel, the slotted channel portion configured to accept the first strap through a slot indicated by a channel reference marking as corresponding to a strap attachment position on the internal face where the third strap is releasably attached; and a cummerbund configured to couple the chest panel to the back panel.

Description

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

As noted above, ill-fitting tactical vests can negatively impact the performance and effectiveness of those relying on this crucial gear. Meanwhile, a well-fitted tactical vest can enhance individual performance and contribute to overall mission success. However, it is not practical for each tactical vest to be manufactured and/or procured as a unique highly tailored garment that is dimensionally bespoke to a particular wearer. In reality, tactical vests are often acquired in bulk orders of a particular vest for distribution to an entire police force, military unit, etc. comprising members of various heights, weights, builds, etc. Further, even if built to the precise dimensions of a user, such a tactical vest would likely fail to offer a perfect fit across all situations (e.g., being worn with different equipment weights, being worn with different equipment configurations/distributions, being worn over/under different types or amount of clothing, etc.).

Ideally, for tactical vests to perform optimally they should be both a uniform or structurally generic piece of equipment that is able to be distributed to and/or used by any wearer and a precisely adjustable piece of equipment that can quickly be personalized to particular dimensions and/or preferences of a wearer to offer optimal fit and comfort. Currently, attempts to introduce adjustability have done little more than introduce multiple failure points, snag risks, and/or superfluous materials that, at best, offer marginal adjustability that ultimately lacks the granularity of adjustment and adaptability necessary to achieve an ideal fit.

Further, these designs are notorious for falling out of adjustment with movement and under asymmetrical loads. Furthermore, designs offering independent adjustability of structurally symmetrical components are equally notorious for producing an asymmetric fit to a tactical. Moreover, many of these designs involve complex adjustments and even require switching out of components which may involve entirely doffing the tactical vest. Unnecessarily removing a tactical vest is at best annoying and at worst a dangerous proposition in many of the environments where they are used. Further, equipment may need to be removed and/or reconfigured to accommodate many of these adjustments with existing designs (e.g., swapping out entire components laden with attached equipment).

In contrast, the mechanisms described herein introduce an adjustable fit tactical vest and/or an apparatus and system for adjusting the fit of a tactical vest in a manner that overcomes all of the limitations of the existing solutions. For example, the adjustable fit tactical vest described herein is highly adjustable and offers a high degree of granularity of adjustment. The described mechanisms seamlessly incorporated this adjustability into the design of the vest such that the precision fit is achieved without introducing multiple failure points, snag risks, and/or superfluous materials. Instead, adjustability is achieved through adjustment mechanisms that are cleanly and securely tucked away and/or are protected from damage or jostling while still being rapidly accessible for quick adjustments. These rugged and protected mechanisms deliver multiple facets of fine-grained adjustments that can be quickly performed in the field without requiring repeated doffing.

The mechanisms introduced herein also firmly secure the adjustment once completed. For instance, once adjustments are made, they are securely fixed and, although this engagement is releasable, the tactical vest will not fall out of adjustment. In addition, the mechanisms incorporate adaptive fit features that allow the fit of the tactical vest to adaptively adjust to the movement and body of the wearer during use without sacrificing the targeted fit of the tactical vest. That is, these mechanisms can accommodate movement, posture changes, external forces, etc. by momentarily adapting the fit the of tactical vest to these instances to avoid pinching, slipping, chaffing, movement restriction, breathing restriction, etc. before automatically returning to the baseline fit of the tactical vest as initially configured and secured by the wearer.

FIGS. 1A-1D illustrate perspective views of examples of an adjustable fit tactical vest, according to various embodiments. Tactical vest 100 may be any type of tactical vest including a plate carrier, chest rig, tactical harness, sporting vest, load-bearing vest, concealed carry vest, etc. As illustrated, tactical vest 100 is a plate carrier configured as a load bearing platform that includes various equipment attachment surfaces (e.g., equipment attachment surface 114, etc.). The equipment attachment surfaces may include a variety of attachment mechanisms such as hook and loop fasteners, modular lightweight load-carrying equipment (MOLLE), buckles, hooks, snaps, quick release mechanisms, etc. that may be used to attach various tactical accessories (e.g., patches, holsters, pouches, medical kits, radios, wires, drink bladders, tools, etc.).

Tactical vest 100 may be configured to carry ballistic armor plate, panels, inserts, etc. The ballistic armor may be made up of any ballistically protective material such as Kevlar, polyethylene, steel, ceramic, etc. These materials may be carried in panels such as chest panel 102, back panel 104, and/or a side panel. These panels may include internal pouches (e.g., sandwiched between the external face 122 and the internal face 126 of the chest panel, sandwiched between internal face 120 and external face 128 of the back panel, etc.) configured to securely house ballistic armor inside. The ballistic armor may be releasably secured within the panels such that a ballistic panel may be removed and/or replaced whenever desired (e.g., ballistic armor becomes damaged, ballistic armor reaches expiration date, a different type of ballistic armor is desired, operational requirements change, etc.).

Tactical vest 100 may be configured to fit a human torso. For example, chest panel 102 may be configured to be suspended over the front of a wearer and cover their chest area including the portion of their chest behind which their vital organs are internally located. Back panel 104 may be configured to be suspended over the back of a wearer and cover their back area including the portion of their back behind which their vital organs are internally located.

A tactical vest 100 may include shoulder straps (e.g., shoulder strap 106). The shoulder straps may couple the chest panel 102 to the back panel 104 of tactical vest 100. The shoulder straps may be configured to rest across a wearer's shoulder and suspend chest panel 102 and back panel 104 in their respective intended positions (e.g., covering the wearer's vital organs). As described in greater detail below, the shoulder strap 106 may ultimately serve as a base strap that may be attached (e.g., stitched) to at least one panel and which may be utilized as a platform to securely engage a plurality of other straps (e.g., chest panel strap 132, back panel strap 134, etc.) into a releasable sandwiched engagement that collectively serves as a shoulder strap in addition to offering the fit adjustments described below.

Tactical vest 100 may include cummerbund 108. A cummerbund 108 may be a sash, a waist strap, a side strap, etc. which rests on a wearer's side and/or waist and couples chest panel 102 to back panel 104. Cummerbund 108 may stabilize the tactical vest 100 against the wearer facilitating a secure fit against a wearer's body and retention of the chest panel 102 and back panel 104 in their intended positions. Cummerbund 108 may help keep the tactical vest 100 from shifting during movement. Cummerbund 108 may also provide additional equipment storage and/or equipment attachment surfaces.

Tactical vest 100 is an adjustable fit tactical vest configured with adjustment mechanism providing adjustable fit via a plurality of adjustment points. The adjustment mechanisms at these adjustment points accommodate coarse and fine-grained fit adjustments to the tactical vest 100. Once the precise desired fit is achieved, these mechanisms securely retain the fit while still allowing the fit of the tactical vest 100 to adapt to the movement of the wearer. Further, these mechanisms facilitate independent adjustment at the various adjustment points but also include referential mechanisms to ensure symmetrical fit adjustments. In addition, the mechanisms facilitate adjustability in the attachment mechanisms connecting the various components (e.g., cummerbund 108, chest panel 102, back panel 104, shoulder strap 106, etc.) of tactical vest 100.

For example, tactical vest 100 may include a first shoulder strap adjustment mechanism 124. The first shoulder strap adjustment mechanism 124 may include a releasable attachment mechanism where a portion of a shoulder strap 106 can releasably mate the internal face 126 of the chest panel 102. Alternatively, or additionally, the first shoulder strap adjustment mechanism 124 could be used as an interface between the shoulder strap 106 and the internal face 120 of the back panel 104.

In various embodiments, the first shoulder strap adjustment mechanism 124 may include a region of hook and loop fastener incorporated into the internal face 126 of the chest panel 102. Shoulder strap 106 may include a corresponding complementary region of hook and loop fastener that can releasably mate to the region of book and loop fastener incorporated into the internal face 126 of the chest panel 102. Hook and loop fastener connections may provide a high degree of adjustability since they do not require precise positioning to achieve engagement. For instance, shoulder strap 106 may be secured to the region of hook and loop fastener incorporated into the internal face 126 of the chest panel 102 at any of a plurality of potential shoulder strap attachment positions where the corresponding hook and loop regions overlap to some extent.

Each of the shoulder straps can be adjusted independently. That is, each of the shoulder straps may be positioned and attached to any of the plurality of potential shoulder strap attachment positions independently. Since each of the shoulder straps are independently positioned, it is possible that they may end up having different wearable lengths upon adjustment. In some instances, the different wearable lengths can produce an asymmetric fit to tactical vest 100.

To prevent an inadvertent asymmetrical fit, the first shoulder strap adjustment mechanism 124 may include a set of reference markings. The set of reference markings may be used as relative position indicators that provide a reference marking against which a relative attachment position of the shoulder strap 106 on the internal face 126 of the chest panel 102. In some examples, a wearer may align the end of the shoulder strap 106 with a reference marking. Then, a wearer may align the end of the other shoulder strap to the same or an equivalent reference marking. Since the two shoulder straps are coaligned with the same or equivalent reference marking they will then be configured with the same wearable length. It should be appreciated that although illustrated as a shared reference marking scale with shared numbering, the set of reference markings may be located and/or configured in any manner that still allows identification of equivalent relative shoulder strap positioning by reference thereto.

In various embodiments, tactical vest 100 may include a second shoulder strap adjustment mechanism 130. The second shoulder strap adjustment mechanism 130 may be a component of the shoulder strap 106. The second shoulder strap adjustment mechanism 130 may include a releasable attachment mechanism through which a chest panel strap 132 is laced when releasably mated to shoulder strap 106 (e.g., via a hook and loop fastener). The chest panel strap 132 may be a load bearing strap which is fastened, such as by stitching, to an external face 122 of chest panel 102. The second shoulder strap adjustment mechanism 130 may include a slotted channel through which the chest panel strap 132 is fed. Depending on which of the slots of the slotted channel that the chest panel strap 132 is laced through, a different angle of hang and/or top of panel height for the chest panel 102 may be achieved. The adjustments offered by lacing through each of the slots may be fine-grained and/or incremental adjustment since the slots are relatively close together.

The slotted channel may include reference markings that are interleaved between the slots. The reference markings may be used as relative position indicators that provide a reference marking against which a relative position of the chest panel strap 132, fed through the slotted channel and into engagement with the shoulder strap 106, can be determined and related to an attachment position of its corresponding shoulder strap to the first shoulder strap adjustment mechanism 124. This is possible because the reference markings of the second shoulder strap adjustment mechanism 130 are configured to correspond to the reference markings on the first shoulder strap adjustment mechanism 124. For example, reference markings on the second shoulder strap adjustment mechanism 130 may be equivalent to corresponding reference markings on the first shoulder strap adjustment mechanism 124. The relationships and/or correspondence in reference markings may facilitate hang angle and panel height adjustments at the second shoulder strap adjustment mechanism 130 that are designed to be precisely matched to the shoulder strap attachment position of the shoulder strap 106. For example, if the shoulder strap attachment position and the slotted channel slot position are identical or equivalent with respect to the reference markings, then the hang angle and/or panel height may be configured within a range that is tailored to the wearable length of the shoulder strap 106. Of course, the further back the wearer draws the chest panel strap 132 before securing to shoulder strap 106, the tighter, higher, and more altered angular hang of the panels, hence the fit, hang angle and/or panel height is configured to match within a range of adjustments to the shoulder strap attachment position.

Tactical vest 100 may also include a first cummerbund adjustment mechanism 116 and/or second cummerbund adjustment mechanism 112. The first cummerbund adjustment mechanism 116 may include an expandable joint housed within a sheath located between an attachment point to the chest panel 102 of the tactical vest 100 and an attachment point to the back panel 104 of the tactical vest 100. This expansion joint may be configured to elastically expand within a limit to increase the wearable length of the cummerbund 108 under tension, acting like a shock absorber. Being located within the sheath may prevent the expansion join from being snagged, being damaged, and/or catching or chaffing against a wearer. In addition, the external face of the sheath may be configured to include equipment attachment surfaces, providing additional real estate for attaching equipment along a wearer's side.

The second cummerbund adjustment mechanism 112 may include a reconfigurable panel attachment portion 110 that can be swapped between any of a plurality of panel attachment mechanisms (e.g., cummerbund closure mechanisms such as hook and loop fastener panels, buckles, quick release tubes, hooks, etc.). For example, the second cummerbund adjustment mechanism 112 may include an attachment mechanism adapter configured to releasably secure a variety of panel attachment mechanisms to cummerbund 108 'on-the-fly'. That is, a wearer may utilize a universal attachment mechanism adapter to switch out panel attachment mechanisms of a cummerbund 108 without doffing, donning, removing or reconfiguring attached equipment, etc. of cummerbund 108.

Figure 2A:
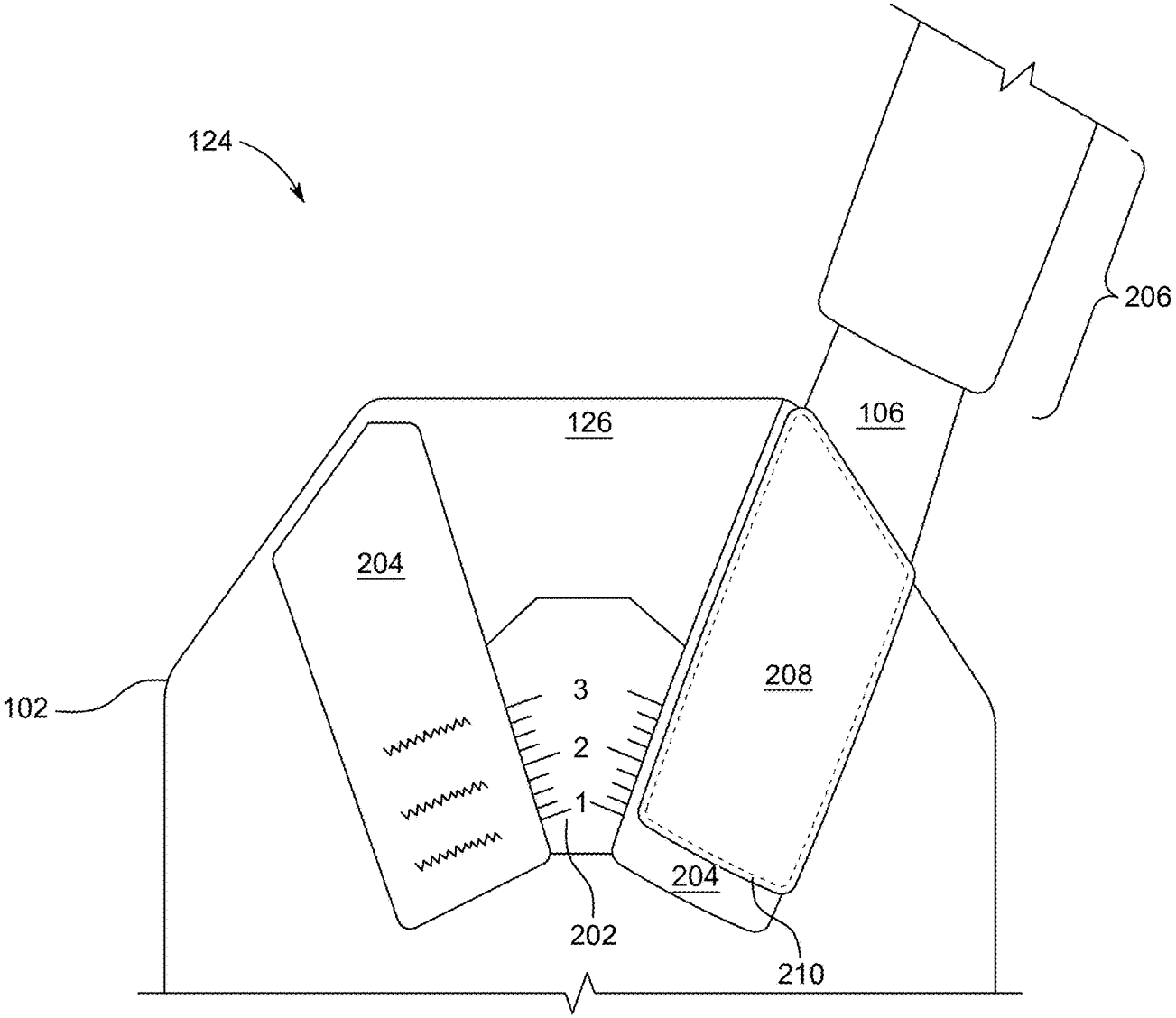
FIGS. 2A-2B illustrate examples of first shoulder strap adjustment mechanism.
Figure 2B:
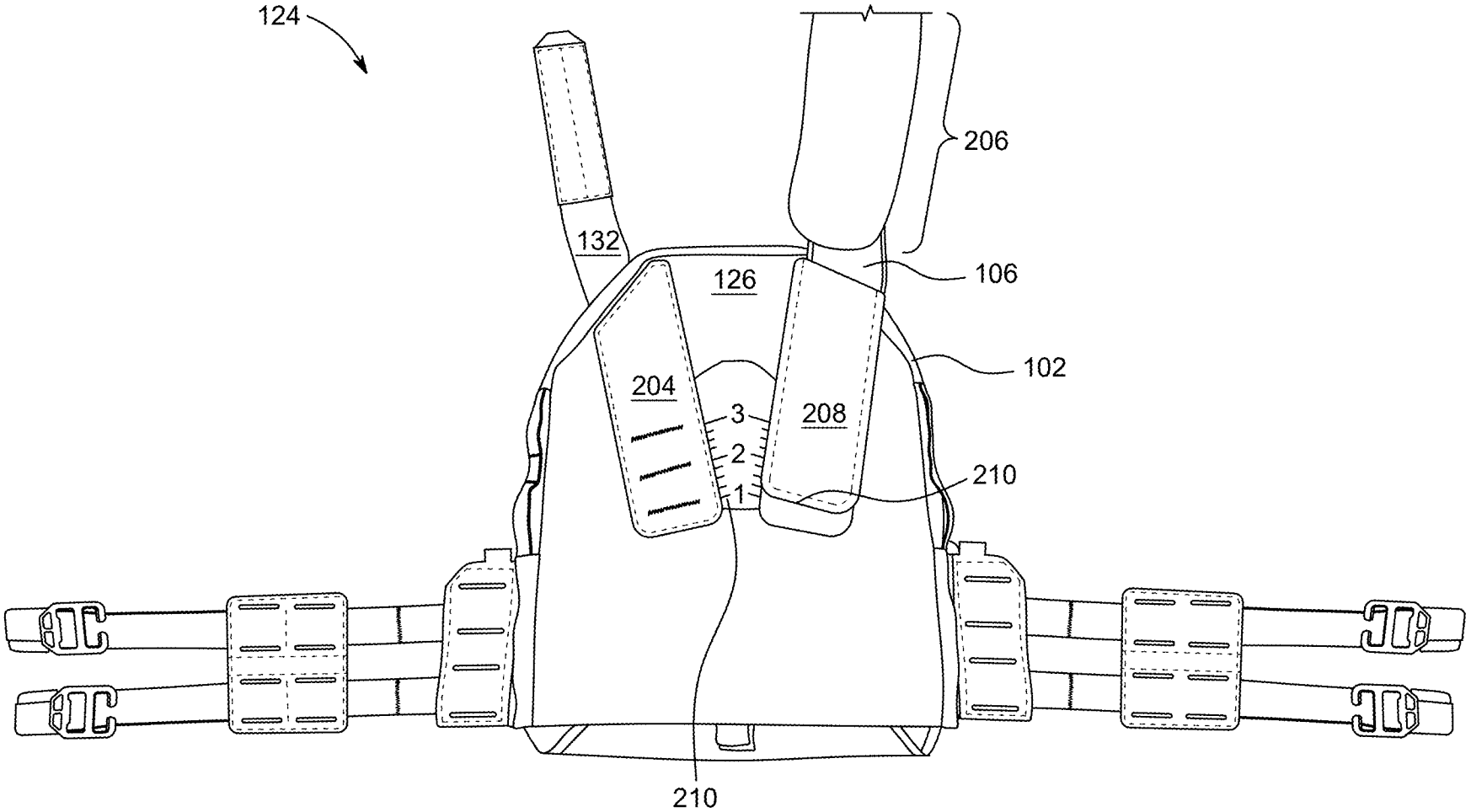

FIGS. 2A-2B illustrate examples of first shoulder strap adjustment mechanism 124, in accordance with one or more embodiments described herein. First shoulder strap adjustment mechanism 124, in combination with second shoulder strap adjustment mechanism 130 described in further detail below, can be utilized to both securely position and hold a back panel 104 and/or chest panel 102 and its contents (e.g., a ballistic plate) while providing a clear, straightforward, quantitative system of shoulder strap length adjustment that can be quickly and repeatedly made symmetrical.

Tactical vests such as plate carriers typically have adjustment systems for fitting the carrier to different sized wearers. Many designs use overlapping hook and loop overlays on the shoulder straps, or a pass-through flap that can be overlapped back on itself to lengthen or shorten each shoulder strap. However, a common problem with existing shoulder adjustment systems is the difficulty in adjusting both shoulders to a symmetrical length.

As described above, hook and loop fastening systems provide a seemingly limitless range of adjustability since they are not limited to a few fixed adjustment positions (e.g., unlike snap points, buckle points, etc.). Given this expansive adjustability, frequently independent adjustments to two different shoulder straps of the same tactical vest yield different wearable lengths of the shoulder straps. Different wearable lengths of shoulder straps may mean that the length of the shoulder strap that is actually wearable (e.g., contacts a wearers shoulder, conforms to a wearer, not the portion of the strap that is stowed/looped back/excess, the portion that rests on the shoulder of the wearer and defines the height at which attached panels hand, etc.) and therefore influences the fit and load bearing symmetry of the vest is different between the shoulder straps. In various embodiments, the wearable length of a shoulder strap may be the length of the shoulder strap spanning between the back panel 104 and/or chest panel 102 attachment points.

Wearing a tactical vest with an asymmetrical fit can lead to one shoulder bearing more load than the other, causing inconsistent fatigue between shoulders, discomfort, injuries, decreased performance, and accidents among various other negative outcomes. Moreover, improper height adjustment of back panel or chest panel, as may be associated with an asymmetric fit, can also lead to improper ballistic plate coverage, as the plates may not be covering the wearer's vital organs properly. Often, there is simply not enough time and/or the danger is too high for users to doff and don a tactical vest multiple times, adjusting fit in between, until a reasonably symmetric fit is achieved with existing adjustment mechanisms. Unfortunately, most wearers simply give up and wear an asymmetrical plate carrier at the cost of their tactical efficacy, comfort, health, and safety.

In contrast, the first shoulder strap adjustment mechanism 124 and/or second shoulder strap adjustment mechanism 130 are configured to provide wearers with a wearer-friendly manner of symmetrically adjusting the fit of a tactical vest. These mechanisms provide the wearer with a simple easy-to-understand mechanism to repeatedly identify and achieve a precise symmetrical fit on a first attempt basis. For example, first shoulder strap adjustment mechanism 124 allows each shoulder strap 106 to have its wearable length independently adjusted while providing the wearer with a reference mechanism by which a precise and repeatable symmetrical fit is identified and/or achieved across both shoulder straps.

First shoulder strap adjustment mechanism 124 may include a first set of reference markings (e.g., reference markings 202). The reference markings 202 may be emblazoned on the internal face 126 of the chest panel 102 and/or on one or more panel attached (e.g., stitched) to the internal face 126 of the chest panel 102. The reference markings 202 may be visible to the wearer when viewing the internal face 126 of chest panel 102.

The reference markings 202 themselves may be graduated markings. A portion of the reference markings 202 may be labeled with and/or distinctly identifiable by a corresponding letter, number, symbol, etc. For example, reference markings 202 may be configured to have a similar appearance to that of a ruler with markings at regularly spaced intervals with some of the markings being labeled with a number or other symbol.

For instance, reference markings 202 may include graduated markings appearing on the internal face 126 of chest panel 102 spaced one quarter of an inch apart from one another. Some of those markings (e.g., those that are located one inch from one another) may be elongated relative to their intervening markings and they may be labeled with a symbol (e.g., a one-, two-, or three-inch indicator, respectively).

The reference markings 202 may be configured to appear next to a shoulder strap attachment panel 204 attached (e.g., stitched) to the internal face 126 of the chest panel 102. The shoulder strap attachment panel 204 may be a panel configured with a fastening mechanism to mate with a complementary fastening mechanism on the chest panel 102. For instance, the shoulder strap attachment panel 204 may be panel of hook and loop fastener that is configured to releasably attach to a complementary panel of hook and loop fastener attached (e.g., stitched) to a side of the shoulder strap 106 that will be facing the internal face 126 of the chest panel 102 when the tactical vest is worn. The shoulder strap attachment panel 204 may be longer than the complementary panel of hook and loop fastener attached to the shoulder strap 106 (e.g., twice as long) in order to accommodate a wide variety of attachment positions and/or wearable length configurations of the shoulder strap 106 along its length.

Each marking of reference markings 202 may be a reference mark for potential shoulder strap attachment positions along shoulder strap attachment panel 204. Being a reference mark for a potential shoulder strap attachment position may mean that the mark provides an indication of an exact attachment position but also a relative marker for attachment positions that may not be in exact alignment with the markings (e.g., in-between two graduated markings of the scale of markings). Each marking of reference markings 202 may be arranged in a scale or ruler pattern escalating along the length of the shoulder strap attachment panel 204. For example, each marking of reference markings 202 may extend perpendicularly from the elongated side of the shoulder strap attachment panel 204 approximately parallel with the bottom edge of the shoulder strap attachment panel 204.

The reference markings 202 may be used to referentially identify and/or quantify an exact attachment position of a shoulder strap 106 to an internal face 126 of chest panel 102. For example, when the shoulder strap 106 is attached to the internal face 126 of chest panel 102, a bottom edge 210 of shoulder strap 106 may be used as a reference edge that is aligned with and/or positionally referred against the reference markings 202. For example, shoulder strap 106 is illustrated being releasably attached to shoulder strap attachment panel 204 such that bottom edge 210 is aligned with the reference marking labeled with the numeral one.

Quantifying the attachment position in this manner may allow a user to easily identify a precise attachment position that has historically provided the wearer with a proper fit of the tactical vest. For instance, the user may know from previous experience that aligning the bottom edge 210 of shoulder strap 106 with the reference marking labeled with the numeral one provides him or her with a good fit. In this manner, the reference markings may be utilized as indicators of wearer fit presets.

Using the reference markings as indicators of wearer presets with respect to fit is not only convenient but it may significantly improve the safety of the wearer. For example, in combat or training a wearer may experience prolonged periods of inactivity (e.g., waiting, observing, staging, eating, sleeping, etc.) punctuated by periods of high intensity activity (e.g., engaging in combat, building fortifications, exercising, running drills, etc.) and/or may be exposed to different weather or environmental conditions throughout the day. Any of these changes may cause a wearer to want to add or shed base layers worn under the tactical vest. Often, the tactical vest will need to be removed to change base layer clothing. Since the tactical vest may house ballistic protection and/or combat equipment, removing it in the field may expose the wearer to additional dangers associated with lacking these protections.

However, with first shoulder strap adjustment mechanism 124, a wearer of a tactical vest may know from previous experience what their fit presets are with respect to different base layer configurations. For example, a wearer may know that that when they add certain additional base layers, they need to realign the bottom edge 210 of shoulder strap 106 so that it aligns with the reference marking labeled with the numeral two in order to provide themselves with a good fit over those base layers. In that case, the user can rapidly and precisely adjust the wearable length of the shoulder straps and/or the fit of the tactical vest to this preset attachment position and rapidly redon the equipment rather than fumbling with and/or adjusting the fit multiple times to try to blindly find the right fit. In short, the first shoulder strap adjustment mechanism 124 may reduce the amount of time that a wearer has their tactical vest removed when performing transitions, thereby reducing their unprotected exposure to ballistic and other threats. This is also realized by using the second shoulder strap adjustment mechanism described in further detail below.

In addition to facilitating the rapid and repeatable fit adjustments, the reference markings of the first shoulder strap adjustment mechanism 124 facilitate a symmetrical fit. That is, although both shoulder straps of a tactical vest can have their wearable length adjusted independently, first shoulder strap adjustment mechanism 124 provides a mechanism by which the wearable lengths across both shoulder straps and/or the overall fit of the tactical vest can be rapidly and repeatably made symmetrical.

For example, a first shoulder strap (e.g., shoulder strap 106) may be releasably attached to a first shoulder strap attachment panel (e.g., shoulder strap attachment panel 204) at an attachment position where its bottom edge (e.g., bottom edge 210) is aligned with the reference marking labeled with the numeral one (e.g., this reference marking having historically provided the wearer a good fit). Then a second shoulder strap may be attached to a second shoulder strap attachment panel at an attachment position where its bottom edge is also aligned with the reference marking labeled with the numeral one. In this manner, the wearable length of the first and second shoulder straps is identical and/or symmetrical given their same relative position to the equivalent reference markings. This will automatically produce a symmetrical fit to the tactical vest without having to perform additional independent adjustments to the shoulder straps. Again, this significantly decreases the amount of time and effort to achieve a symmetrical fit and renders the same fit reproducible across adjustments.

Moreover, first shoulder strap adjustment mechanism 124 facilitates rapid and reproducible fit adjustments even when they involve different wearable lengths. Say, for instance, that a wearer's anatomy, loadout, base layer configuration, etc. renders their anatomical geometry asymmetric and/or causes the tactical vest to fit asymmetrically even when both shoulder straps are adjusted to the same wearable length. In these instances, the wearer may quickly realize that perhaps a right side shoulder strap needs to be attached to its corresponding shoulder strap attachment panel at an attachment position where its bottom edge is aligned with the reference marking labeled with the numeral one, while a left side shoulder strap needs to be attached to its corresponding shoulder strap attachment panel at an attachment position where its bottom edge is aligned with the reference marking labeled with the numeral two in order to produce a symmetrical fit despite asymmetric wearable lengths. The wearer may utilize this positioning and/or its implied spatial offset to rapidly and reproducibly achieve a symmetrical fit that is tailored to their unique geometry.

In addition, each shoulder strap may be configured with one or more padded portions to aid in the wearer's comfort and help minimize fatigue and injury. For example, shoulder strap 106 may include a chest padding portion 208. The chest padding portion 208 may include a padding panel attached (e.g., stitched) to a side of the shoulder strap 106 that will be facing and/or contacting the wearer's chest when the tactical vest is worn. Additionally, or alternatively, the shoulder strap may include a shoulder padding portion 206. Shoulder padding portion 206 may include a padding panel attached (e.g., stitched) to a side of the shoulder strap 106 that will be facing and/or contacting the wearer's shoulder when the tactical vest is worn.

Figure 3A:
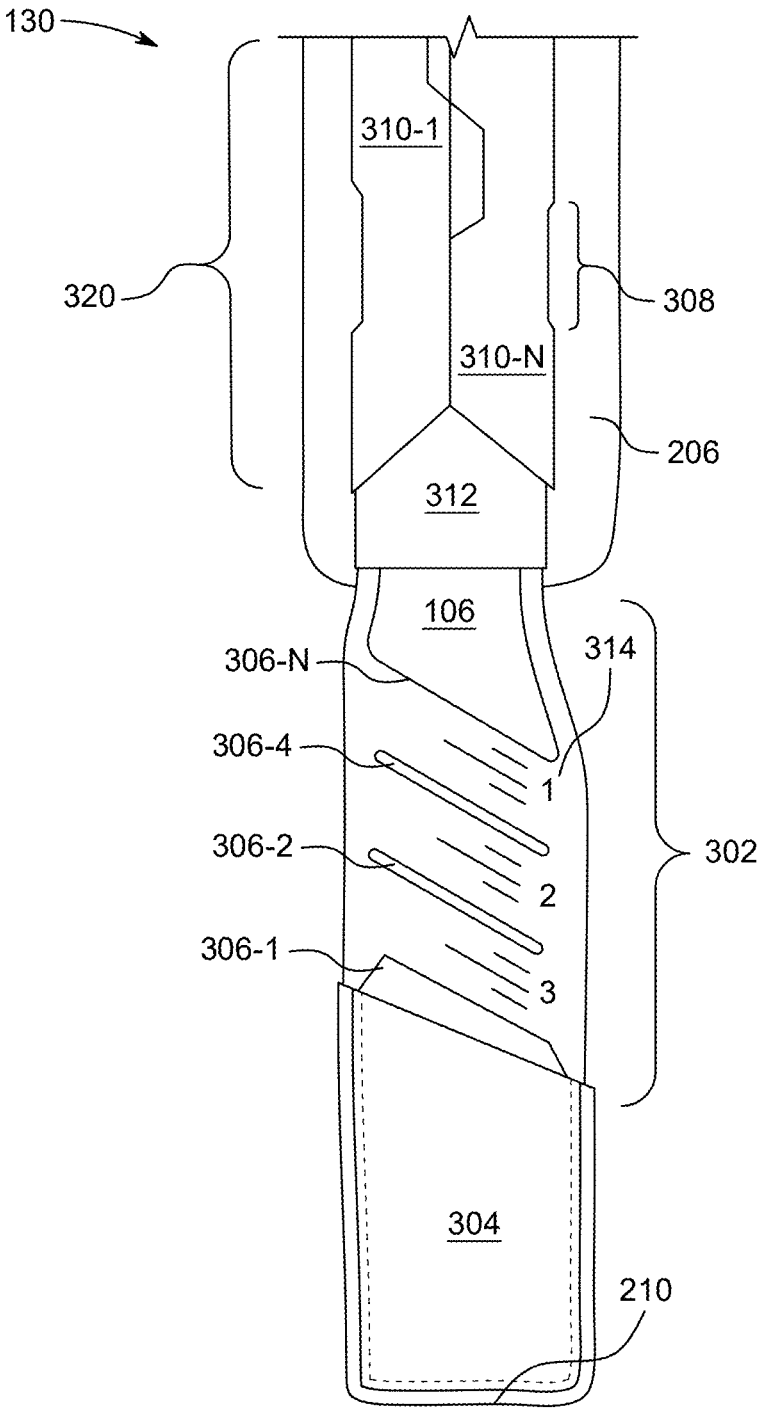
FIGS. 3A-3B illustrate examples of a second shoulder strap adjustment mechanism not engaged with a tactical vest panel.
Figure 3B:
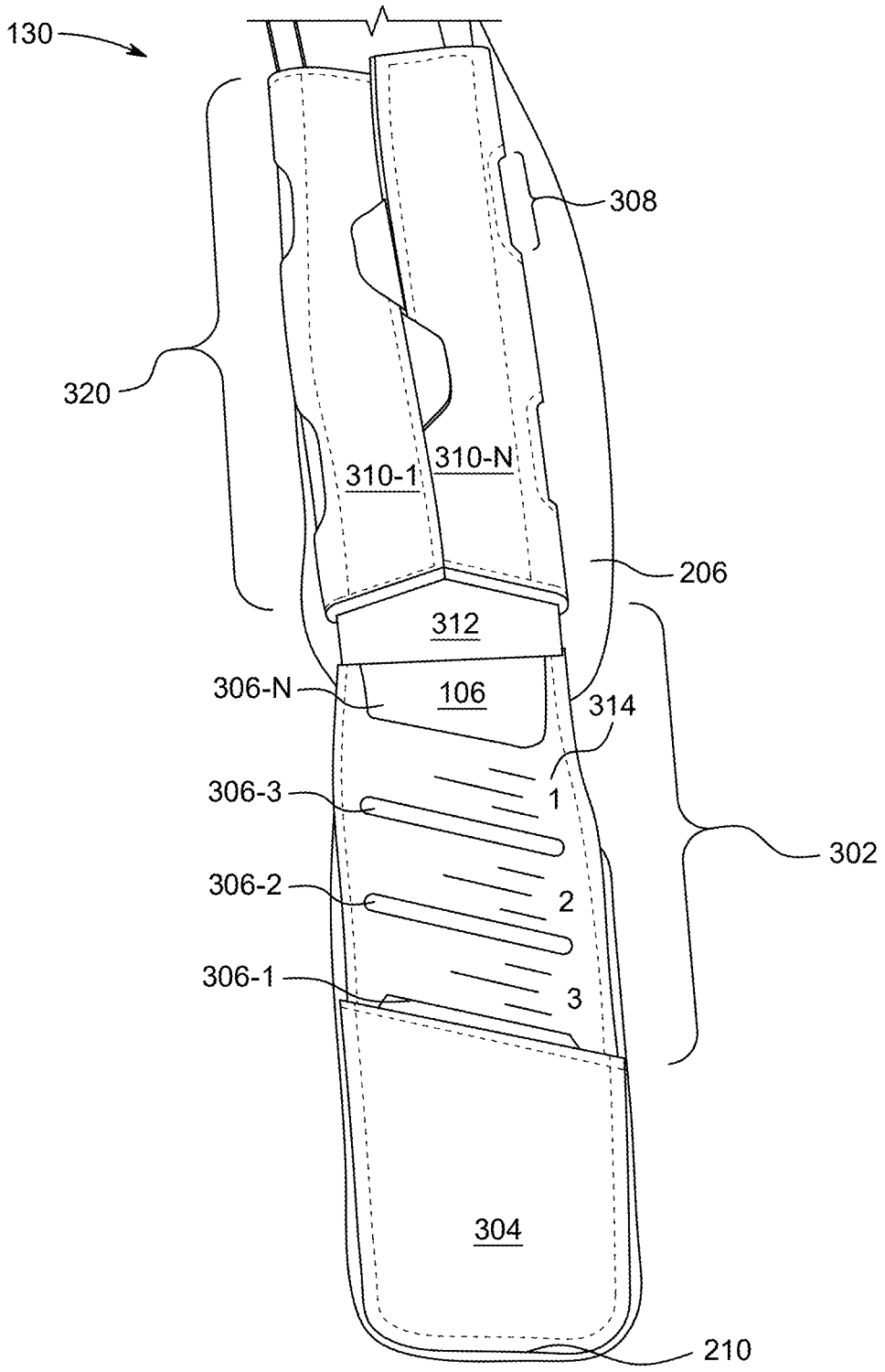

FIGS. 3A-3B illustrate examples of a view of a second shoulder strap adjustment mechanism 130 not engaged with a tactical vest panel, in accordance with one or more embodiments described herein. Second shoulder strap adjustment mechanism 130, in combination with first shoulder strap adjustment mechanism 124 described above, can be utilized to both securely position and hold a back panel 104 and/or chest panel 102 and its contents (e.g., a ballistic plate) while providing a clear, straightforward, quantitative system of fit adjustment that can be quickly and repeatedly made symmetrical. Moreover, the second shoulder strap adjustment mechanism 130 can facilitate fine-grained adjustments to the hanging angle and/or hanging height of the back panel 104 and/or chest panel 102 that can be made on-the-fly (e.g., without doffing the tactical vest).

Second shoulder strap adjustment mechanism 130 may be a complementary mechanism to and/or configured to be used in tandem with first shoulder strap adjustment mechanism 124. Second shoulder strap adjustment mechanism 130 may be integrated with each shoulder strap (e.g., shoulder strap 106). The second shoulder strap adjustment mechanism 130 may be located above the bottom edge 210 and/or the shoulder strap attachment panel 304, which is configured to releasably mate with shoulder strap attachment panel 204.

The second shoulder strap adjustment mechanism 130 may include a slotted channel 302. Slotted channel 302 may include a panel attached (e.g., stitched) along its elongate sides to shoulder strap 106. Slotted channel 302 may be left unattached to shoulder strap 106 at its top, bottom, and in between the stitched elongate sides such that a channel is formed between the panel and the shoulder strap 106 within the stitched elongate sides. The slotted channel 302 may include a plurality of slots 306 (e.g., 306-1 . . . 306-N) forming elongate openings into the channel along the length of the panel.

Each of the plurality of slots 306 may be dimensioned to accommodate passage of a corresponding panel strap (e.g., back panel strap 134, chest panel strap 132, etc.) into and/or out of the channel.

The slotted channel 302 may include slotted channel reference markings 314. The slotted channel reference markings 314 may be emblazoned on an external face of the slotted channel 302 such that they are visible on its face. The slotted channel reference markings 314 may be at least partially visible in the front on view of the chest panel 102 even when the shoulder strap 106 is fully engaged with shoulder strap attachment panel 204.

The slotted channel reference markings 314 may correspond to the reference markings 202 of the first shoulder strap adjustment mechanism 124 (e.g., those appearing on the internal face 126 of chest panel 102). That is, each of the slotted channel reference markings 314 may correspond to an equivalent reference marking appearing on the internal face 126 of chest panel 102. This correspondence may indicate which of the plurality of slots 306 that a panel strap should be laced through in order to provide a hang angle, plate height, fit, etc. that matches the shoulder strap attachment position in which the shoulder strap 106 is attached. For instance, if a bottom edge 210 of shoulder strap 106 is aligned with the reference marking labeled with the numeral one on the first shoulder strap adjustment mechanism 124 then the second shoulder strap adjustment mechanism 130 may be configured such that lacing the panel strap into and out of the slots (e.g., 306-4 and 306-N) bordering the slotted channel reference marking labeled with the numeral one may automatically tailor the hang angle, the panel height, the fit, etc. of the tactical vest to that shoulder strap attachment position.

Above the final slot (e.g., 306-N) of the slotted channel 302, second shoulder strap adjustment mechanism 130 may include a locking channel 320. Locking channel 320 may be configured to releasably capture and/or lock (e.g., with a hook and loop fastening mechanism) a panel strap within a channel. For instance, locking channel 320 may include a locking channel floor 312. The locking channel floor 312 may include a releasable fastener such as a panel of hook and loop material attached (e.g., stitched) to shoulder strap 106 (e.g., to a same face as the shoulder strap attachment panel 304, to a face opposite the shoulder padding portion 206, etc.).

In addition, locking channel 320 may include one or more flaps such as locking flaps 310 (e.g., 310-1 . . . 310-N). The locking flaps 310 may include articulable flaps with extension portions attached (e.g., stitched) to the shoulder strap 106 under the locking channel floor 312. The locking flaps 310 may open to expose the locking channel floor 312 and may close to seal the locking channel 320 and form its roof. In various embodiments, the locking flaps 310 may include a fastener panel 324 (e.g., 324-1 . . . 324-N) (e.g., hook and loop material) attached (e.g., stitched) to the internal face of the locking flaps 310 that will face the inside of the locking channel 320 when closed. When an item such as a panel strap (e.g., chest panel strap 132, back panel strap 134, etc.) is inserted in locking channel 320 and the locking flaps 310 are closed, then the item, which may include fasteners such as hook and loop material itself, will be releasably locked into place via releasable engagement with the fastener panels 324 of the locking flaps 310 and/or the locking channel floor 312.

As previously mentioned, the locking flaps 310 may include extension portions attached to shoulder strap 106. Between these extension portions, the body of the locking flaps 310 may be discontinuous such that a pass-through slot 308 is formed in between each of the extension portions. A pass-through slot 308 may form a side entrance into the locking channel 320. Each pass-through slot 308 may be used to accommodate the passage of straps and/or auxiliary equipment (e.g., for cable routing/management, equipment mounting, equipment storage, etc.) within locking channel 320. Therefore, locking channel 320 may accommodate and/or releasably lock into place both panel straps and auxiliary equipment such as by sandwiching them between the layers locked within the locking channel 320.

Figure 4A:
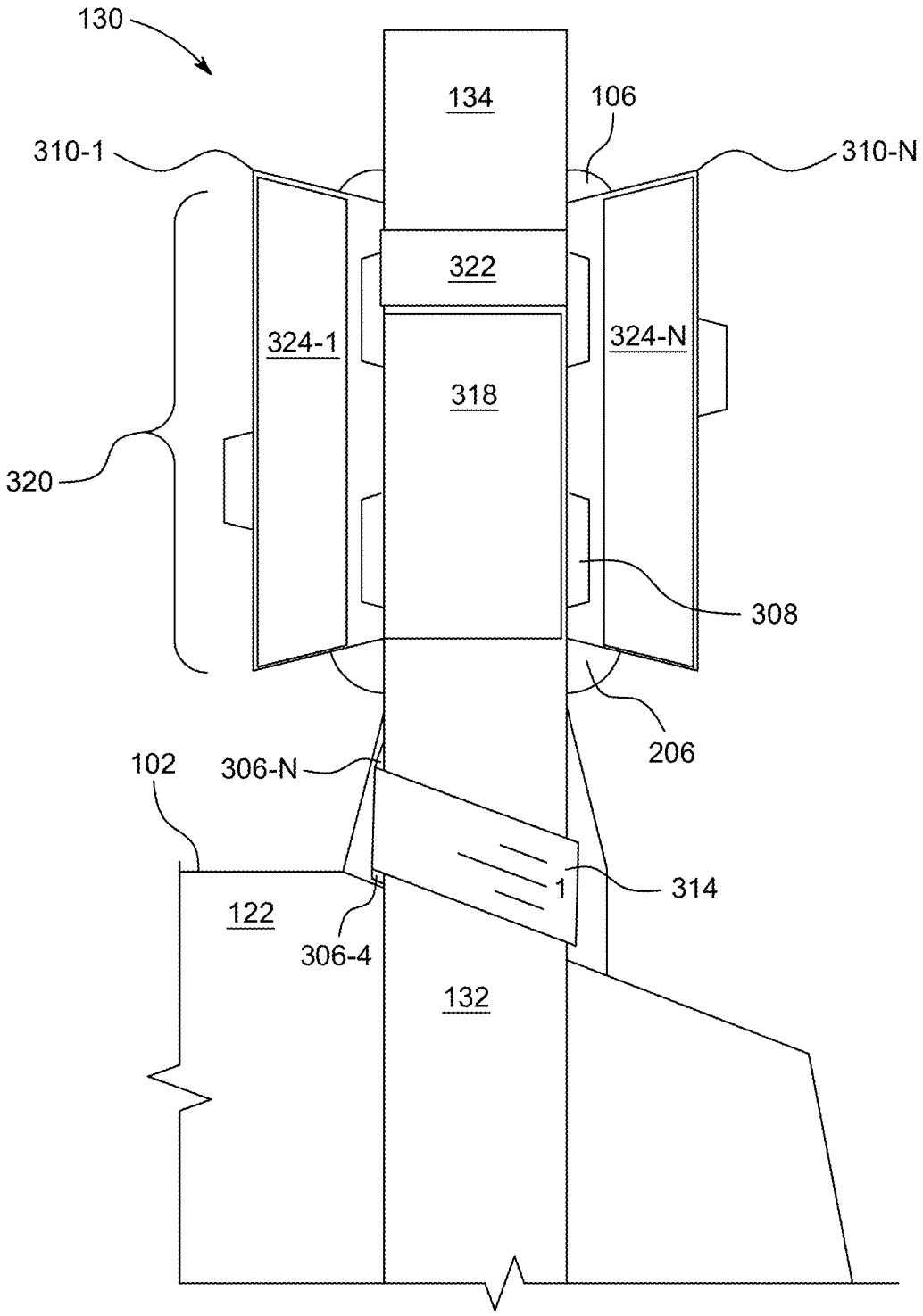
FIGS. 4A-4B illustrate examples of the second shoulder strap adjustment mechanism engaged with a tactical vest panel.
Figure 4B:
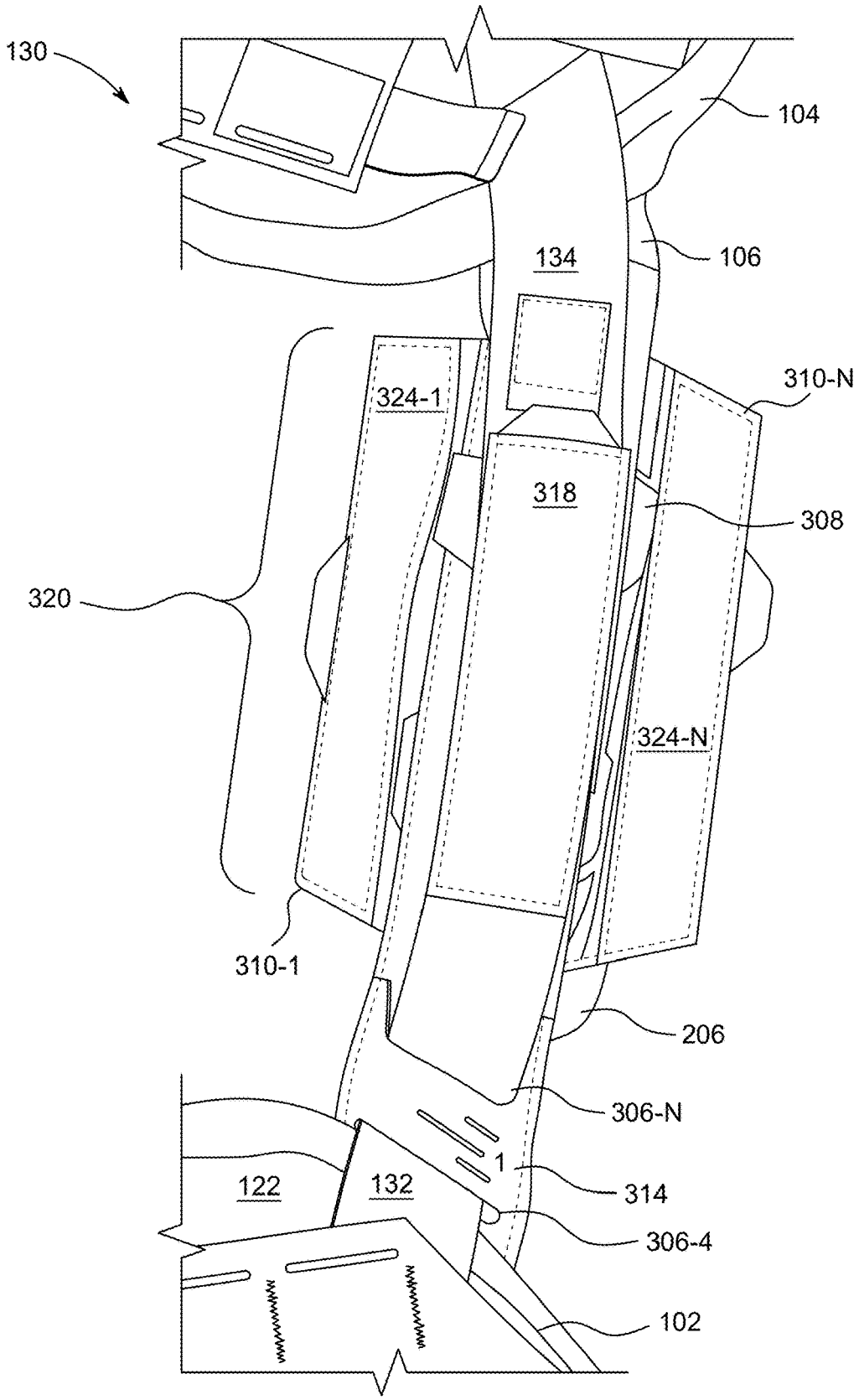

FIGS. 4A-4B illustrate examples of the second shoulder strap adjustment mechanism 130 engaged with a tactical vest panel, in accordance with one or more embodiments described herein. Specifically, the second shoulder strap adjustment mechanism 130 is illustrated engaged with chest panel 102.

Chest panel 102 may include a chest panel strap 132. Chest panel strap 132 may be a thirty-eight-millimeter nylon strap. Chest panel strap 132 may be attached (e.g., stitched) to an external face 122 of chest panel 102. The chest panel strap 132 may extend down the external face 122 of the chest panel 102 to a point at or below halfway down the chest panel 102. A chest panel 102 may include two or more chest panel straps that run diagonally from a corner of a chest panel 102 collectively forming a V-shape attachment to the external face 122. The chest panel strap 132 may be used to help distribute the load of ballistic plates and hold the chest panel 102 snuggly against the body of the wearer when engaged in locking channel 320. Back panel straps (e.g., back panel strap 134) may be similarly configured with respect to the back panel 104.

Again, the slotted channel reference markings 314 may be configured to correspond to the reference markings 202 of the first shoulder strap adjustment mechanism 124 (e.g., those appearing on the internal face 126 of chest panel 102). Here, bottom edge 210 of shoulder strap 106 is aligned with the reference marking labeled with the numeral one on the first shoulder strap adjustment mechanism 124 as illustrated in FIGS. 2A-2B. Therefore, chest panel strap 132 is laced into and out of the slotted channel at slots (e.g., 306-4 and 306-N) bordering the slotted channel reference marking labeled with the numeral one on the second shoulder strap adjustment mechanism 130. Accordingly, the hang angle, the panel height, the fit, etc. of the chest panel 102 and/or the back panel of the tactical vest is automatically tailored to the shoulder strap attachment position corresponding to the number one on the second shoulder strap adjustment mechanism 130.

Additional fine-grained adjustments may be achieved by pulling the chest panel strap 132 tighter and releasably fixing it in place further back within locking channel 320. For example, the further back in the locking channel 320 that the chest panel strap 132 is releasably fixed, the higher the chest panel 102 and/or back panel may ride when worn. Adjustments to the back panel strap 134 may produce similar effects. The chest panel strap 132 may be releasably captured in the locking channel 320 overlapping the back panel strap 134 that is also captured in the locking channel. For instance, back panel strap 134 and chest panel strap 132 may include fastener panels (e.g., chest panel strap fastener panel 318, back panel strap fastener panel 322) on both faces of the strap so that they can be releasably locked into a sandwich configuration by engagement with each other and/or by engagement with the locking channel floor 312 and/or the fastener panels 324 on the internal face of the locking flaps 310. When the locking channel 320 is closed, the back panel strap 134 and the chest panel strap 132 may be locked into place releasably securing the tactical vest fit.

Figure 5A:
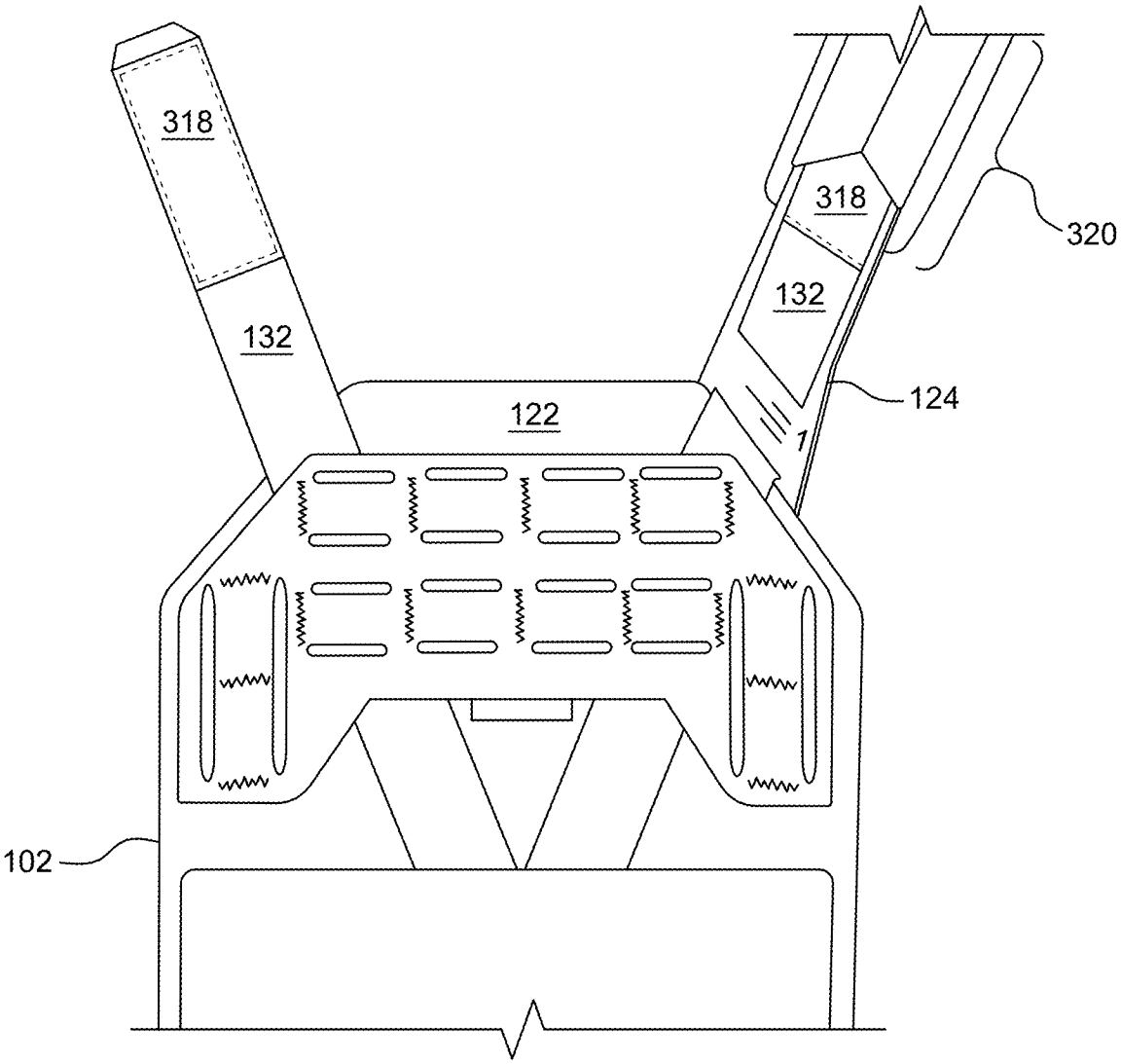
FIGS. 5A-5B illustrate examples of a second shoulder strap adjustment mechanism engaged with a tactical vest panel.
Figure 5B:
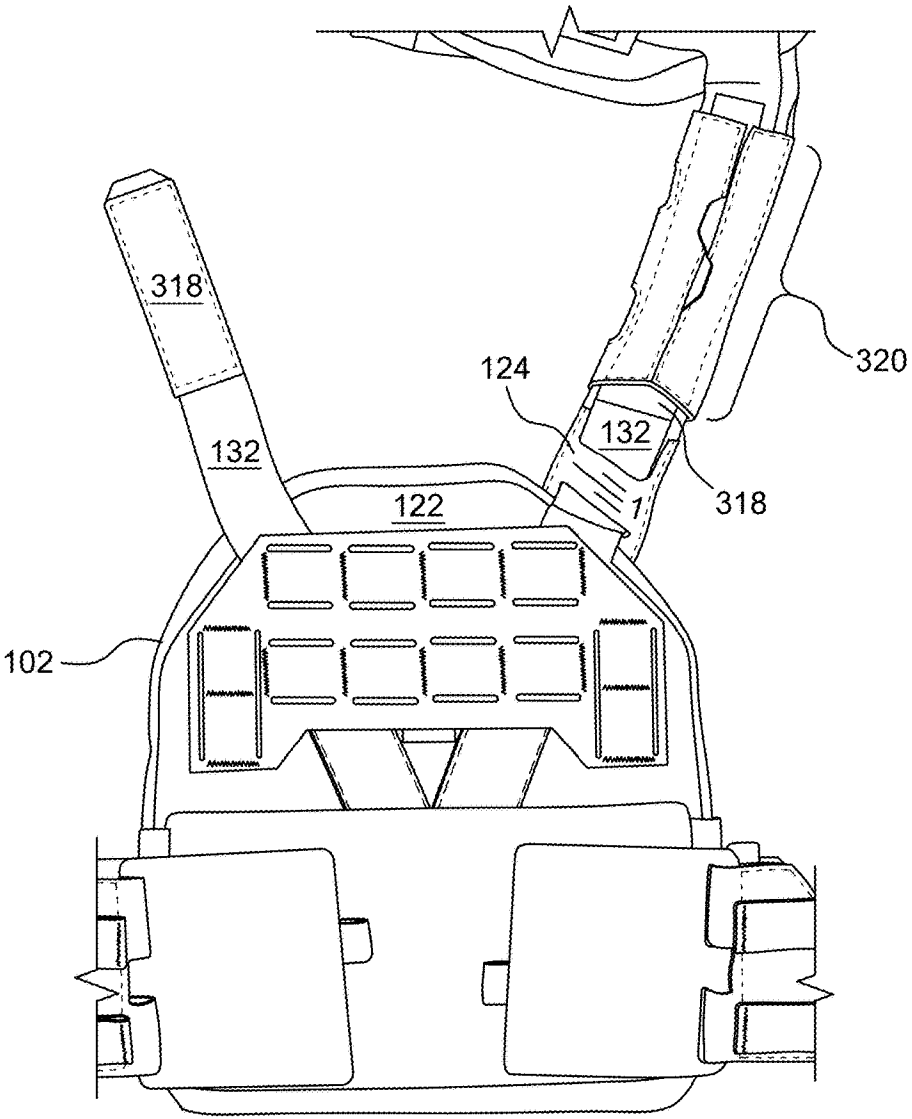

FIGS. 5A-5B illustrate examples of a view of the second shoulder strap adjustment mechanism 130 engaged with a tactical vest panel, in accordance with one or more embodiments described herein. Second shoulder strap adjustment mechanism 130 is illustrated engaged with a chest panel strap 132. The chest panel strap 132 is attached to an external face 122 of chest panel 102 and is laced through the slotted channel of second shoulder strap adjustment mechanism 130. The chest panel strap 132 is illustrated locked in to locking channel 320 with chest panel strap fastener panel 318 releasably engaged within the locking channel 320.

Figure 6A:
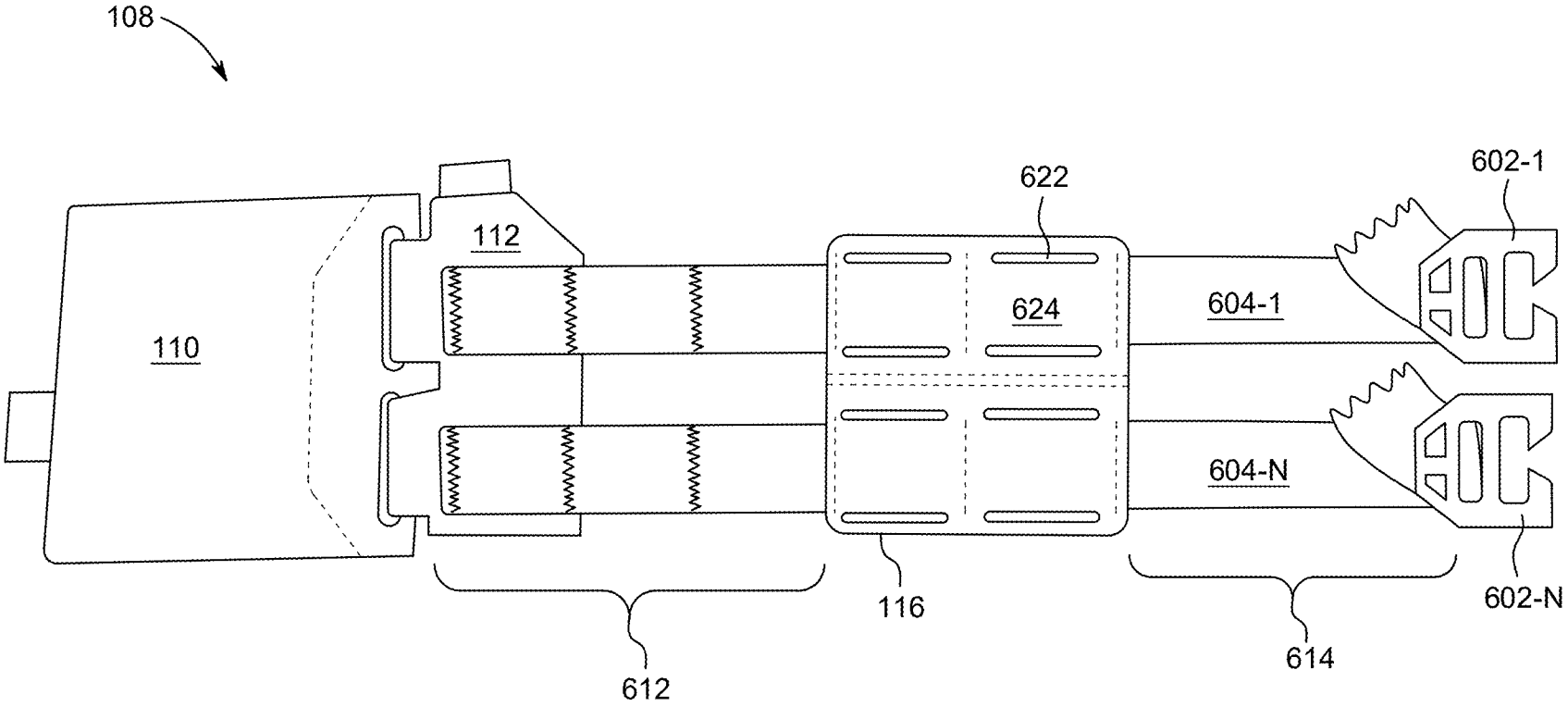
FIGS. 6A-6C illustrate examples of cummerbunds with a first cummerbund adjustment mechanism.
Figure 6B:
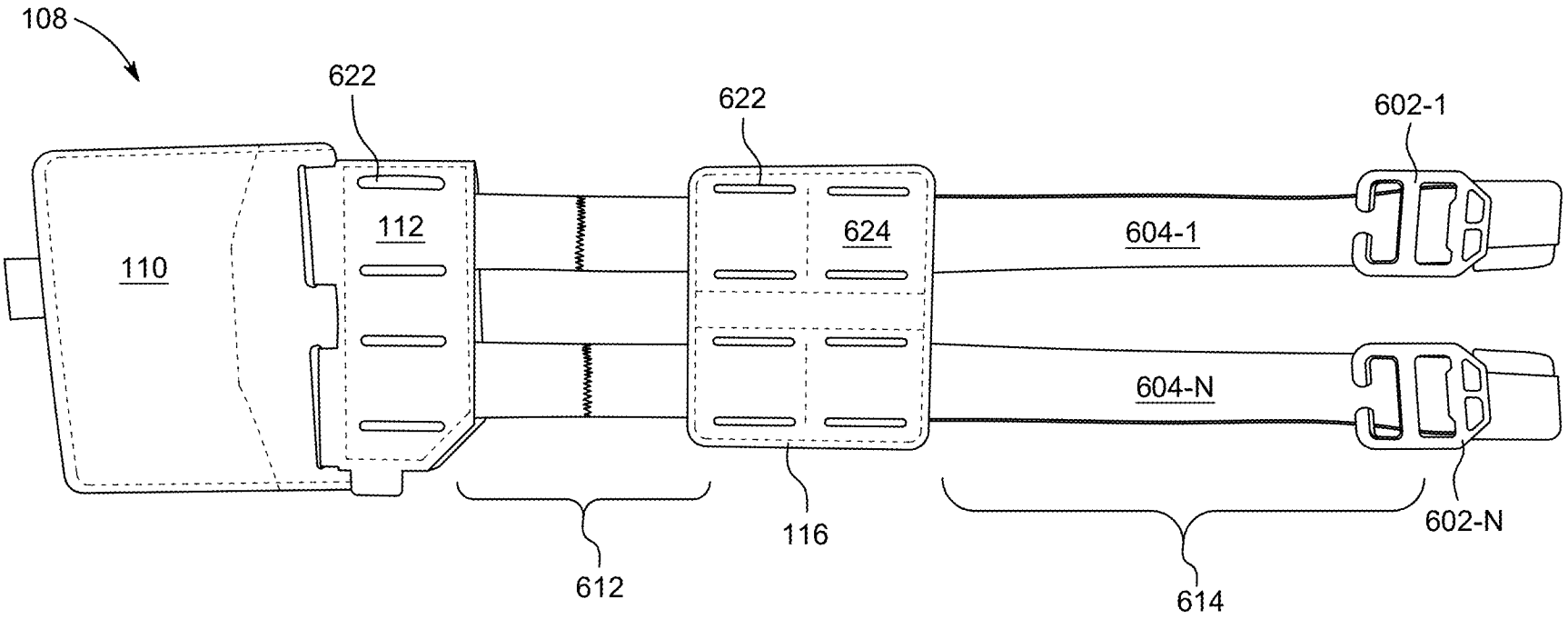
Figure 6C:
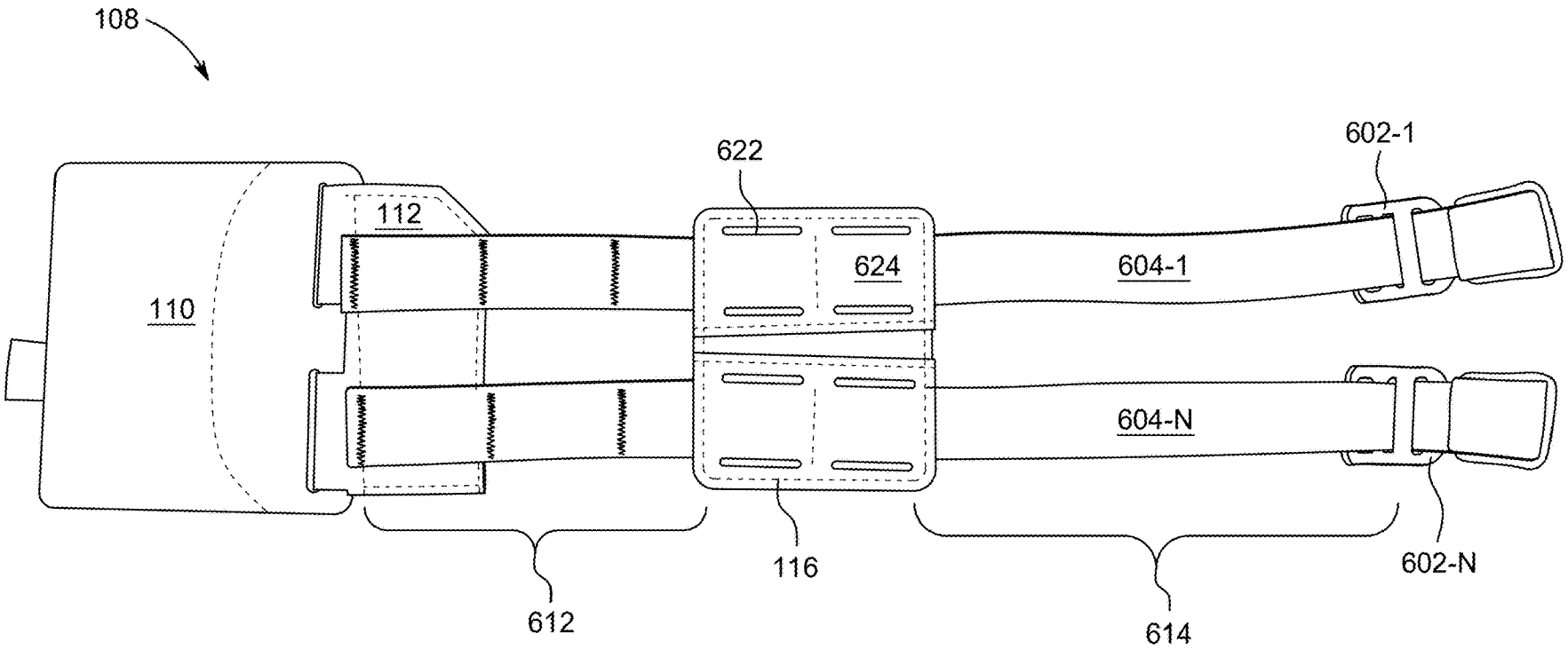

FIGS. 6A-6C illustrate examples of cummerbund 108 with a first cummerbund adjustment mechanism 116, in accordance with one or more embodiments described herein. Cummerbund 108 is configured as an expandable coupler between a chest panel and a back panel of a tactical vest. Cummerbund 108 may be configured to couple the panels of a tactical vest across the sides of a wearer's torso (e.g., at the rib cage, at the waist, at the sides of abdomen, etc.).

Cummerbunds typically include one or more cummerbund straps that span between connection points to the tactical vest panels. Cummerbund straps may be made of a high tensile strength material such as nylon webbing. While such materials have some elasticity, they generally have a much higher modulus of elasticity and/or are less elastic than elastic banding. Generally, nylon webbing in cummerbunds is not elastic enough to avoid restricting the wearer's freedom of movement and/or reducing oxygen intake by torso constriction during periods of heightened activity. However, while elastic banding can alleviate this restriction, it is prone to damage, snagging, snapping, etc. and consumes valuable real estate on the tactical vest. That is, utilizing elastic banding for the entire length of a cummerbund means that the surface of the cummerbund cannot be used as an attachment point for additional equipment and/or pouches since it necessarily needs to expand and contract.

In contrast, the first cummerbund adjustment mechanism 116 of cummerbund 108 provides dynamic expansion and contraction of the cummerbund 108 that responds to a wearer's movement. The first cummerbund adjustment mechanism 116 additionally protects both the expansion mechanism (e.g., from abrasion, snagging, overstretching, etc.) and the wearer (e.g., from discomfort, friction, pinching, chaffing, etc.). Moreover, first cummerbund adjustment mechanism 116 adds additional attachment points to the tactical vest.

Cummerbund 108 includes cummerbund straps 604 (e.g., 604-1 . . . 604-N). Cummerbund straps 604 may be constructed of a high tensile strength material such as nylon webbing or tape that are configured to span across the sides of a wearer to couple a chest panel to a back panel of a tactical vest. The cummerbund straps 604 may include a first portion 612 and a second portion 614. The first portion 612 may include a double layer of the high-tensile strength material attached (e.g., stitched) to one another at regular intervals. The second portion 614 may include a single layer of the high-tensile strength material. The first portion 612 may be attached (e.g., stitched) to a second cummerbund adjustment mechanism 112 which may be releasably attached to a reconfigurable panel attachment portion 110. Reconfigurable panel attachment portion 110 may be configured to releasably engage with a complementary attachment mechanism on a panel of the tactical vest (e.g., a hook and loop panel, etc.). The second portion 614 may be attached to another panel attachment portion such as a pincer buckle 602 (e.g., 602-1 . . . 602-N). The pincer buckle 602 may be configured to be releasably attached to attachment mechanisms such as MOLLE, etc.

Cummerbund 108 may include expansion joints (e.g., one for each of the cummerbund straps 604) that are housed within an expansion joint sheath 624. Each expansion joint may include a mechanism which allows the wearable length of the cummerbund to dynamically adapt to loads experience during movement of a wearer. Specifically, the expansion joint may stretch under load and return to its original state once the load is released. This action may allow the wearer greater freedom of movement and reduced oxygen restriction/torso constriction during periods of heightened activity. The expansion joint and its integrated protective mechanism are described in greater detail below with respect to FIGS. 7A-7B.

The expansion joint sheath 624 may surround and contain the expansion joint within a pouch inside of the sheath. The expansion joint may remain within expansion joint sheath 624 whether in its expanded or unexpanded state. The expansion joint sheath 624 may be attached (e.g., stitched) to the cummerbund straps 604 at one end. For example, the expansion joint sheath 624 may be attached directly to the first portion 612 of the cummerbund straps 604 but not to the second portion 614 of the cummerbund straps 604. This asymmetrical attachment may make it such that the second portion 614 of the cummerbund straps 604 is not fully trapped within the expansion joint sheath. Therefore, any load on the second portion 614 of the cummerbund straps 604 is transferred to the expansion joint housed within the expansion joint sheath 624. Under load, the expansion joint may expand within expansion joint sheath 624. This may allow the second portion 614 of the cummerbund straps 604 to slip partially out of the expansion joint sheath 624 under load. As a result, the wearable length of the cummerbund straps 604 may expand under load as the length of the cummerbund between the panels is momentarily elongated.

The expansion joint sheath 624 may house the expansion joint protecting it from snagging, catching, tangling, abrading, running, damage, etc. In addition, the expansion joint sheath 624 may act as pad or shield that protects the wearer from discomfort, friction, skin abrasion, clothing damage, injury, changing, pinching, etc. caused by the expansion and contraction of the expansion joint and its movement along the sides of the wearer. The external face of the expansion joint sheath 624 may include a mounting surface 622. The mounting surface 622 may include attachment mechanisms such as hook and loop fasteners. MOLLE, buckles, hooks, snaps, quick release mechanisms, etc. that may be used to attach various tactical accessories. In addition, at external face of second cummerbund adjustment mechanism 112, described in greater detail with respect to FIG. 8A-8F below, may also include mounting surface 622.

Figure 7A:
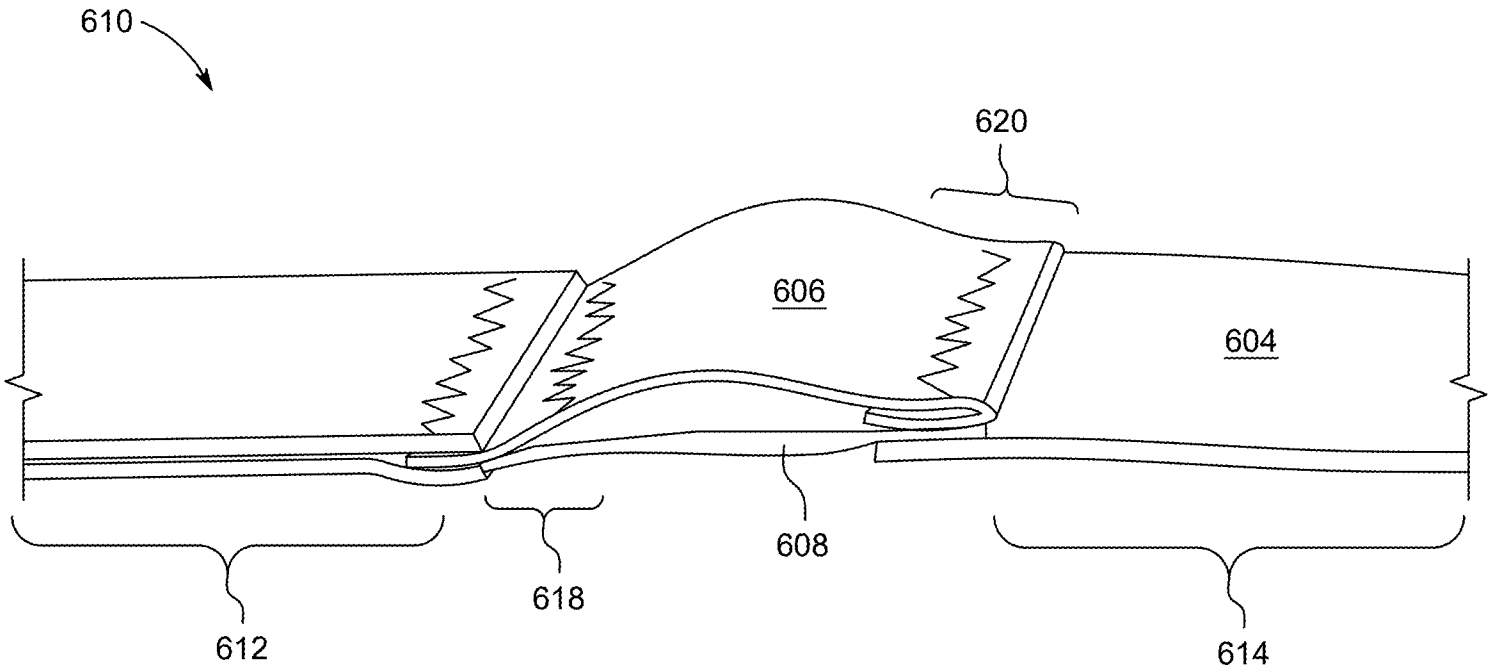
FIGS. 7A-7B illustrate examples of an expansion joint of the first cummerbund adjustment mechanism.
Figure 7B:
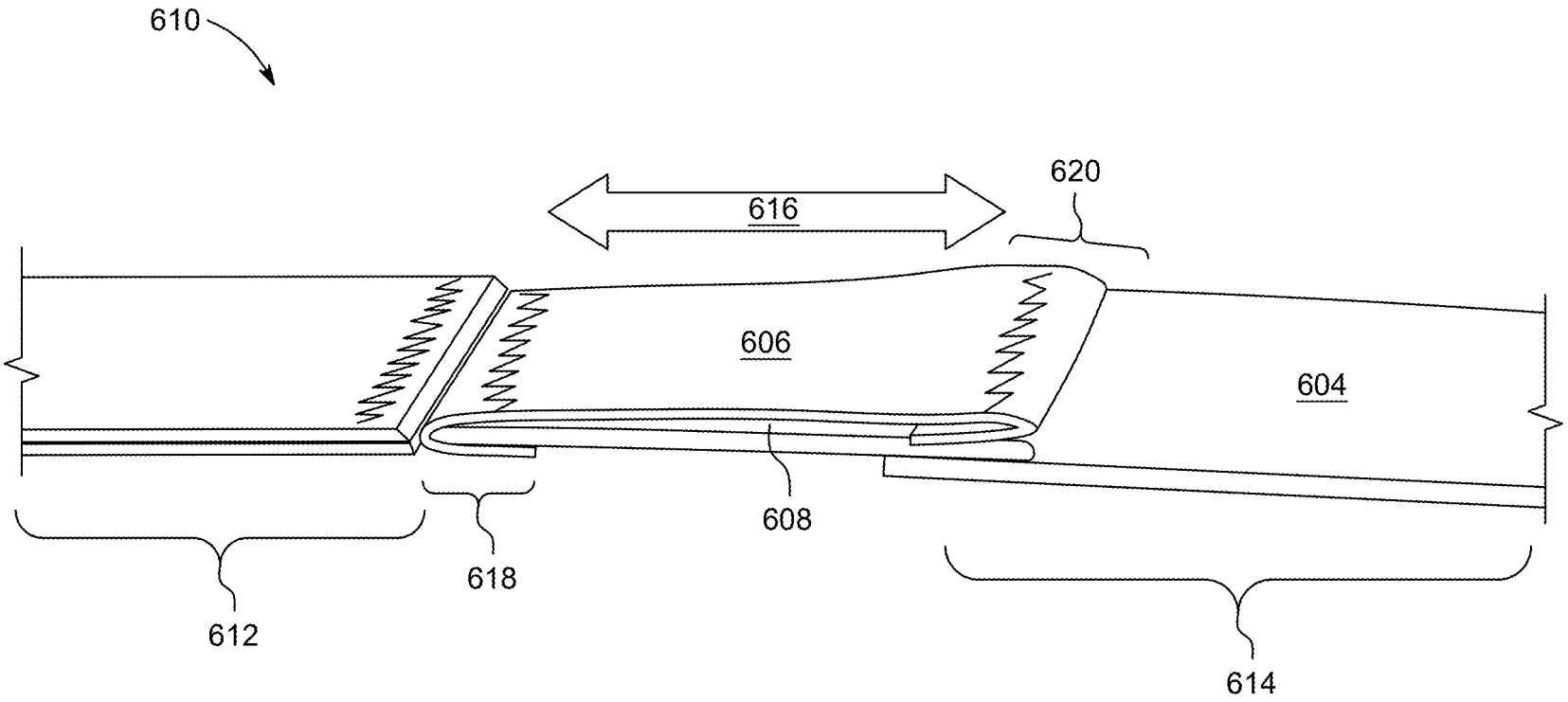
Figure 8A:
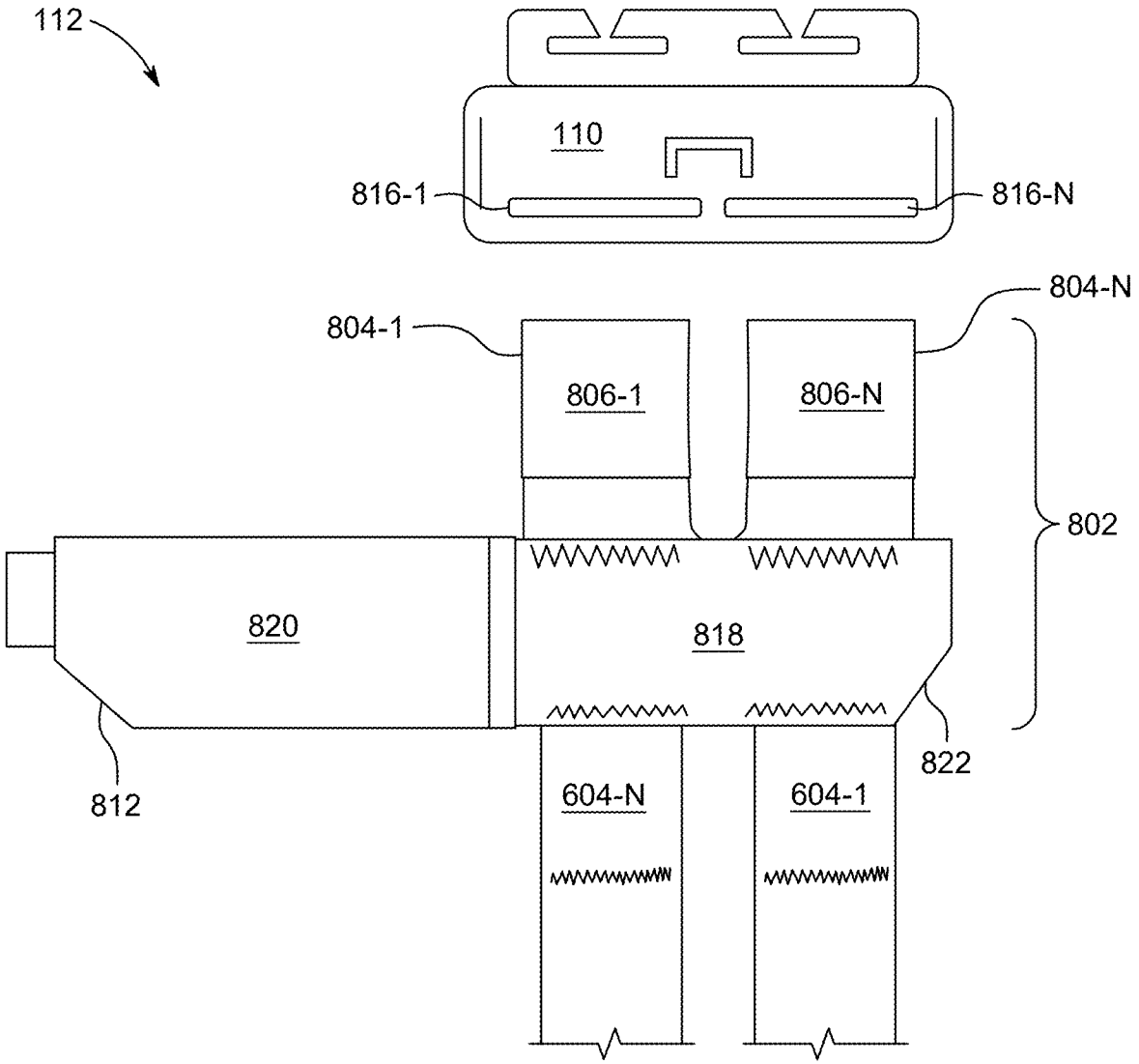
FIGS. 8A-8K illustrate examples of a second cummerbund adjustment mechanism progressing through various stages of engagement with a reconfigurable panel attachment portion.
Figure 8B:
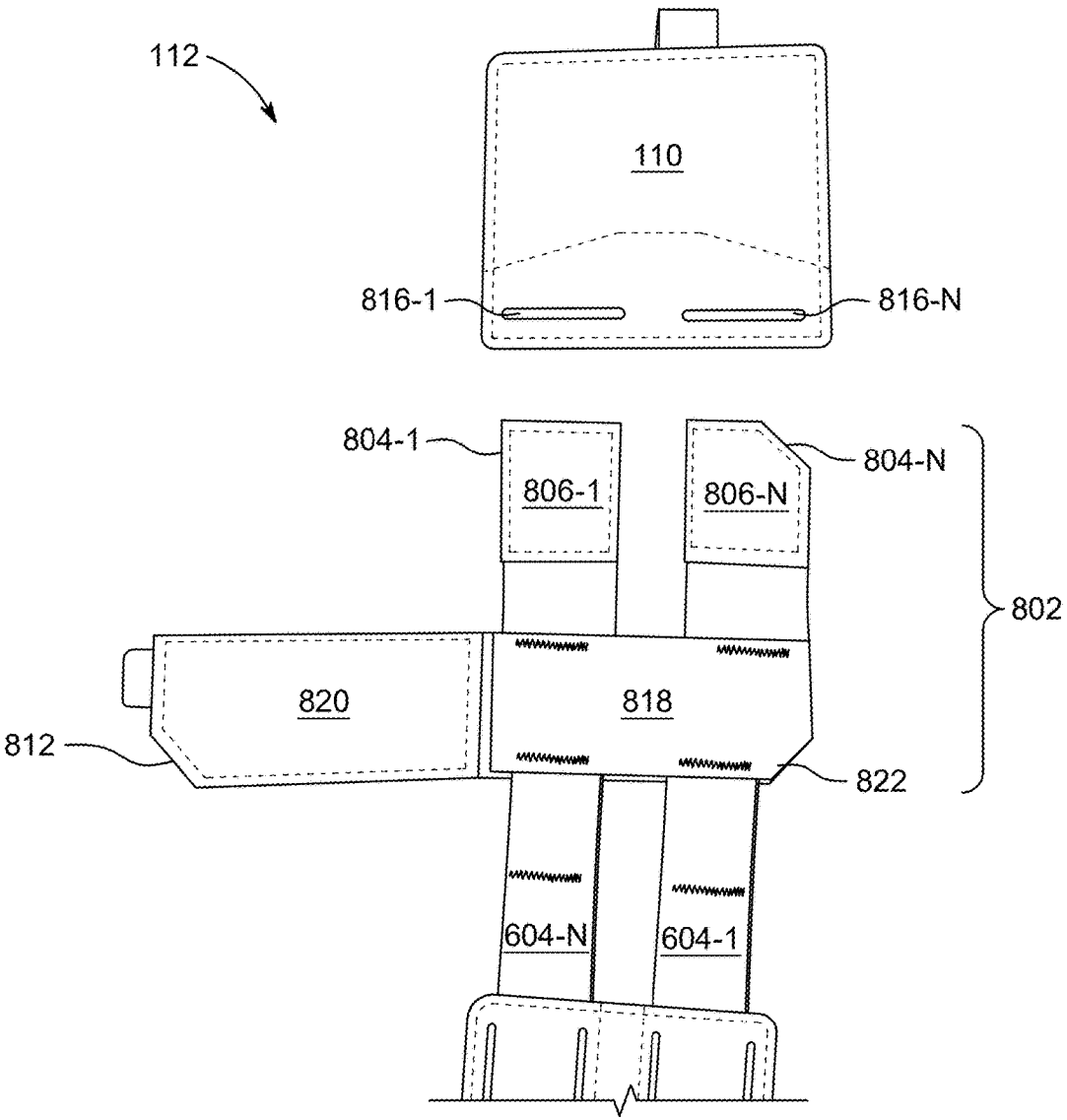
Figure 8C:
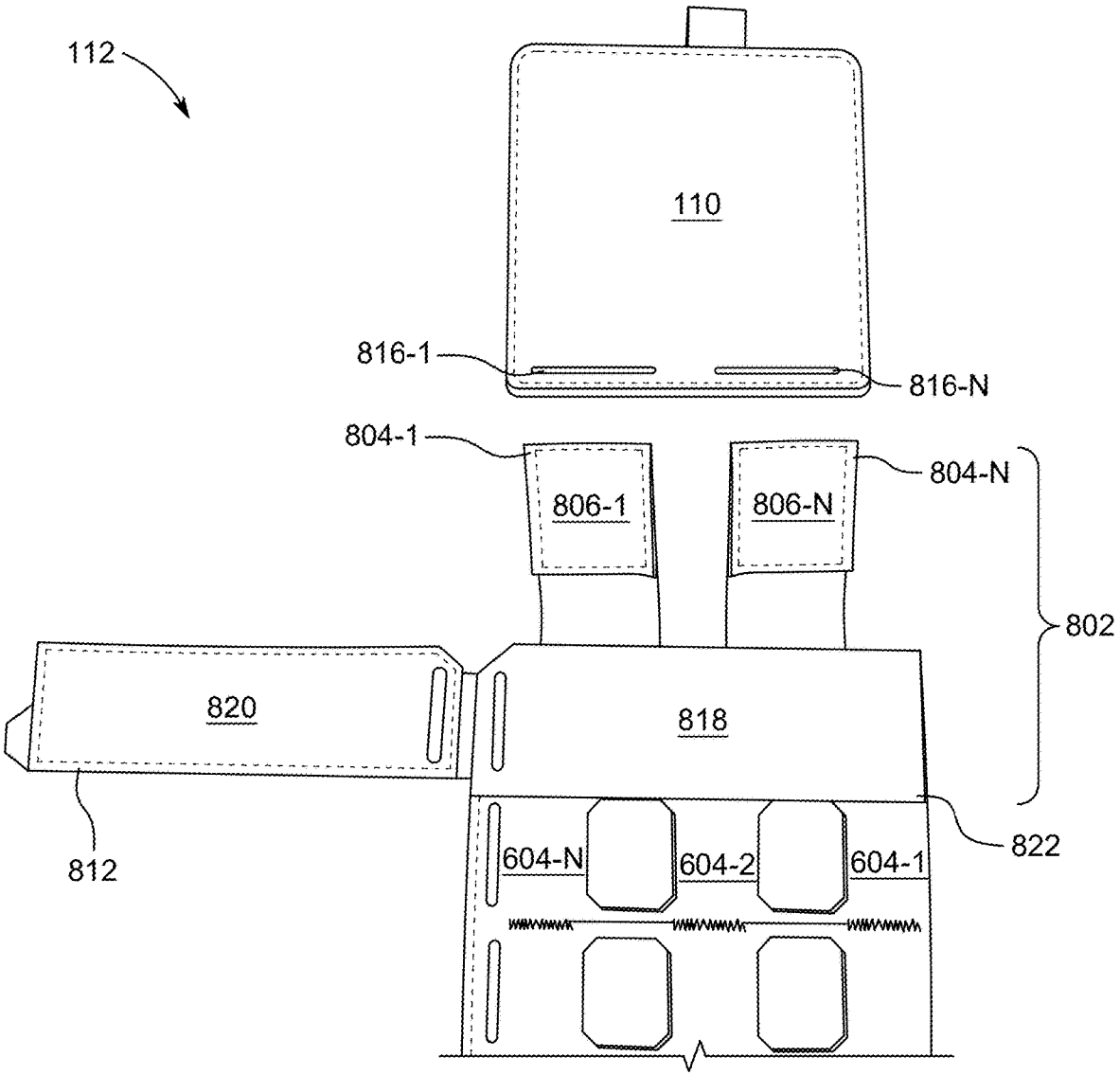
Figure 8D:
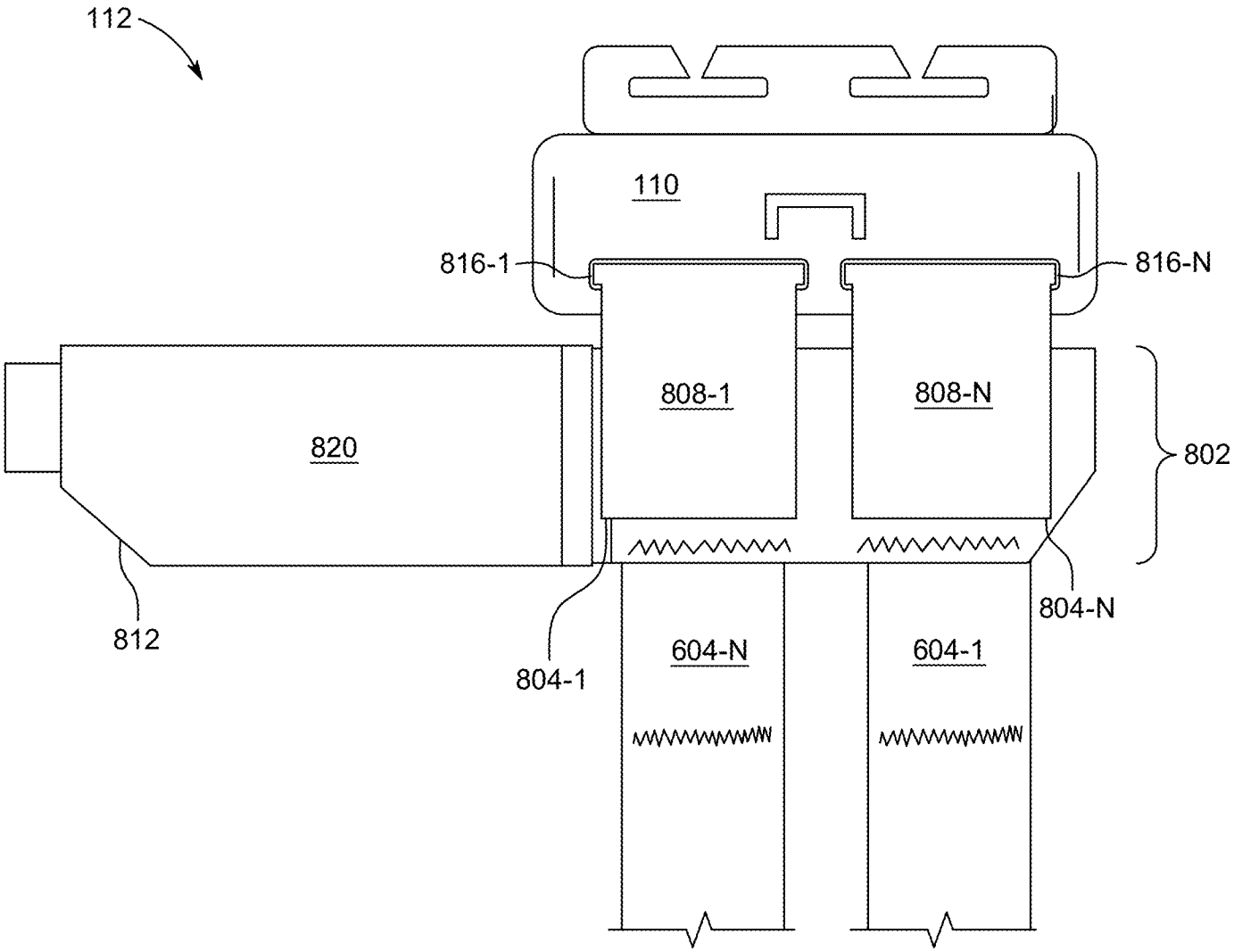
Figure 8E:
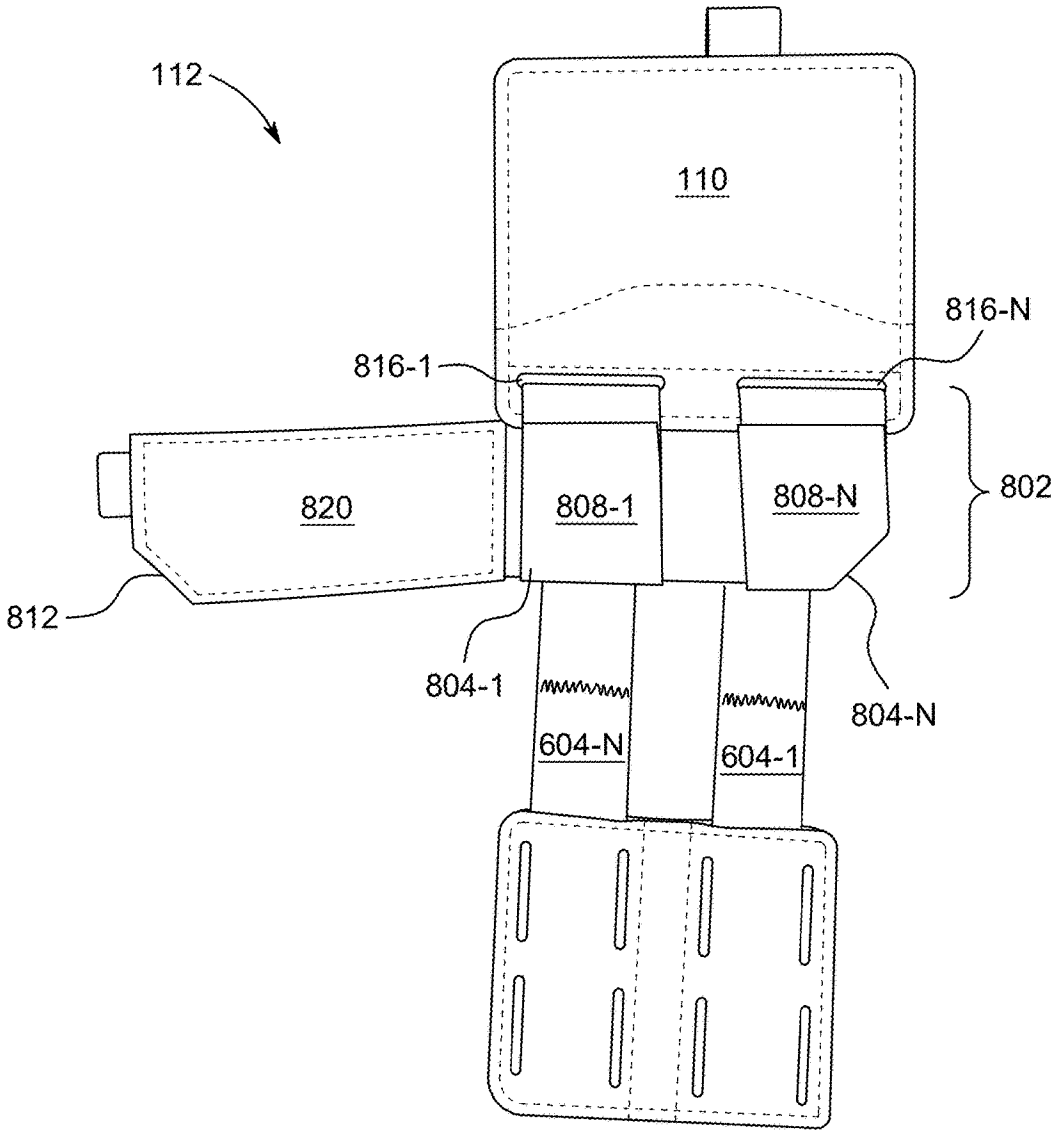
Figure 8F:
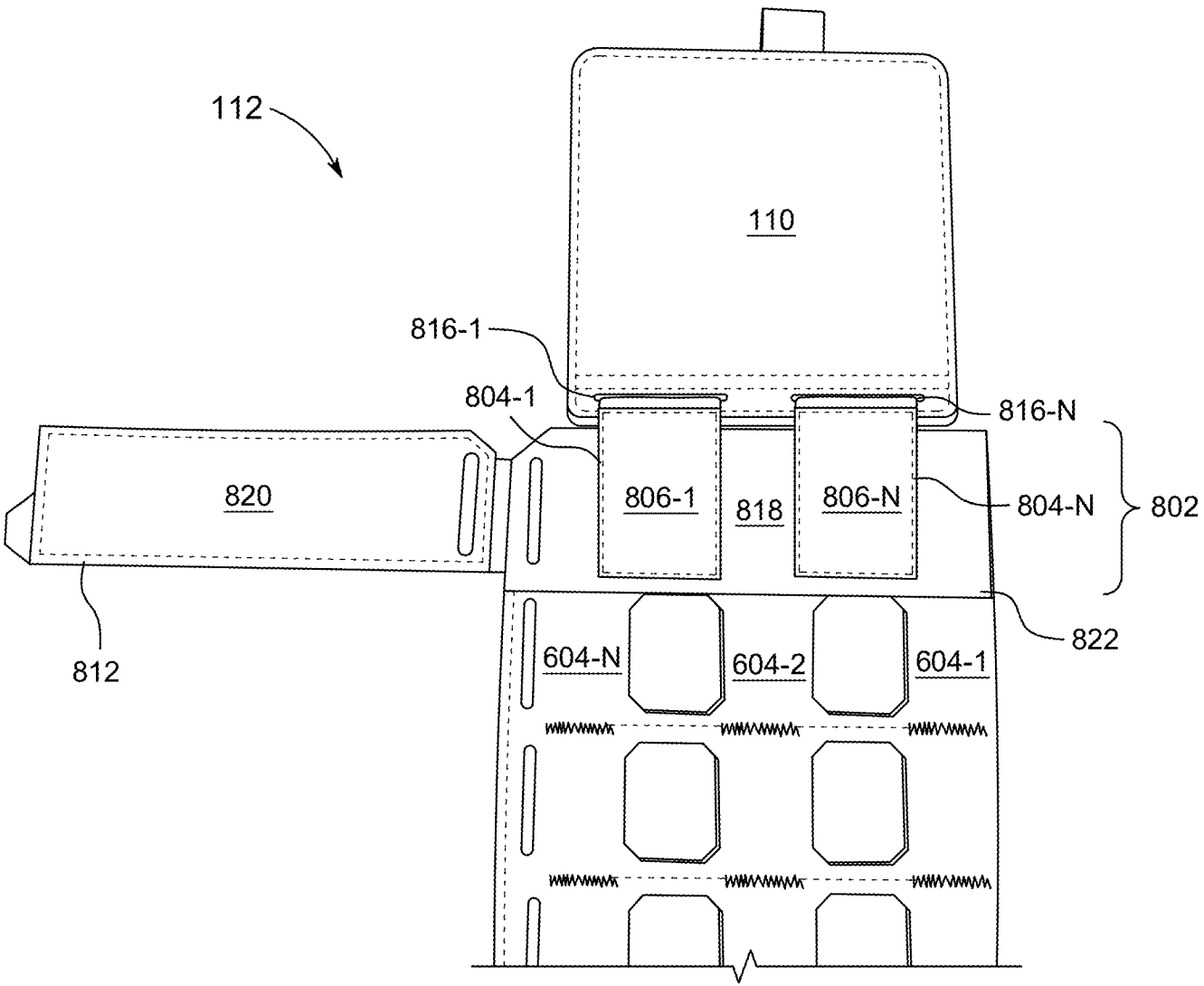
Figure 8G:
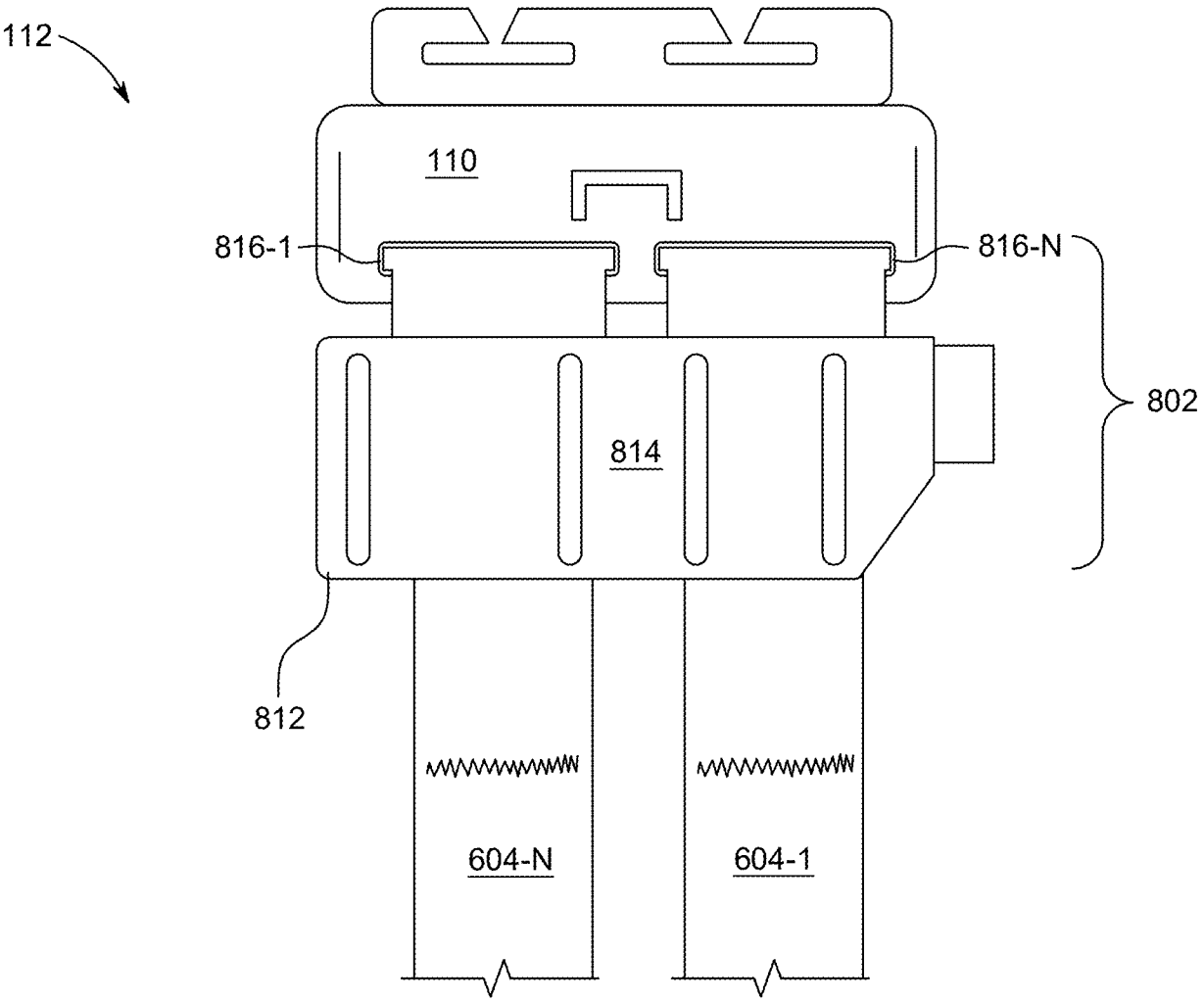
Figure 8H:
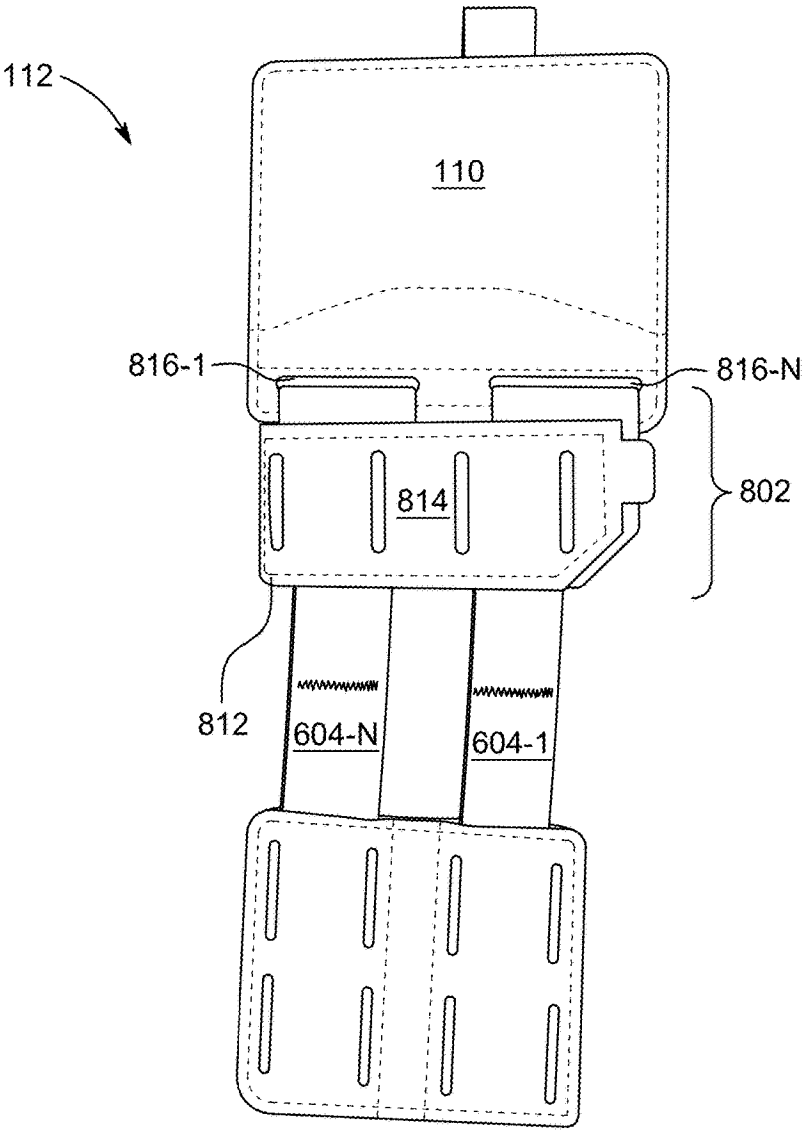
Figure 8I:
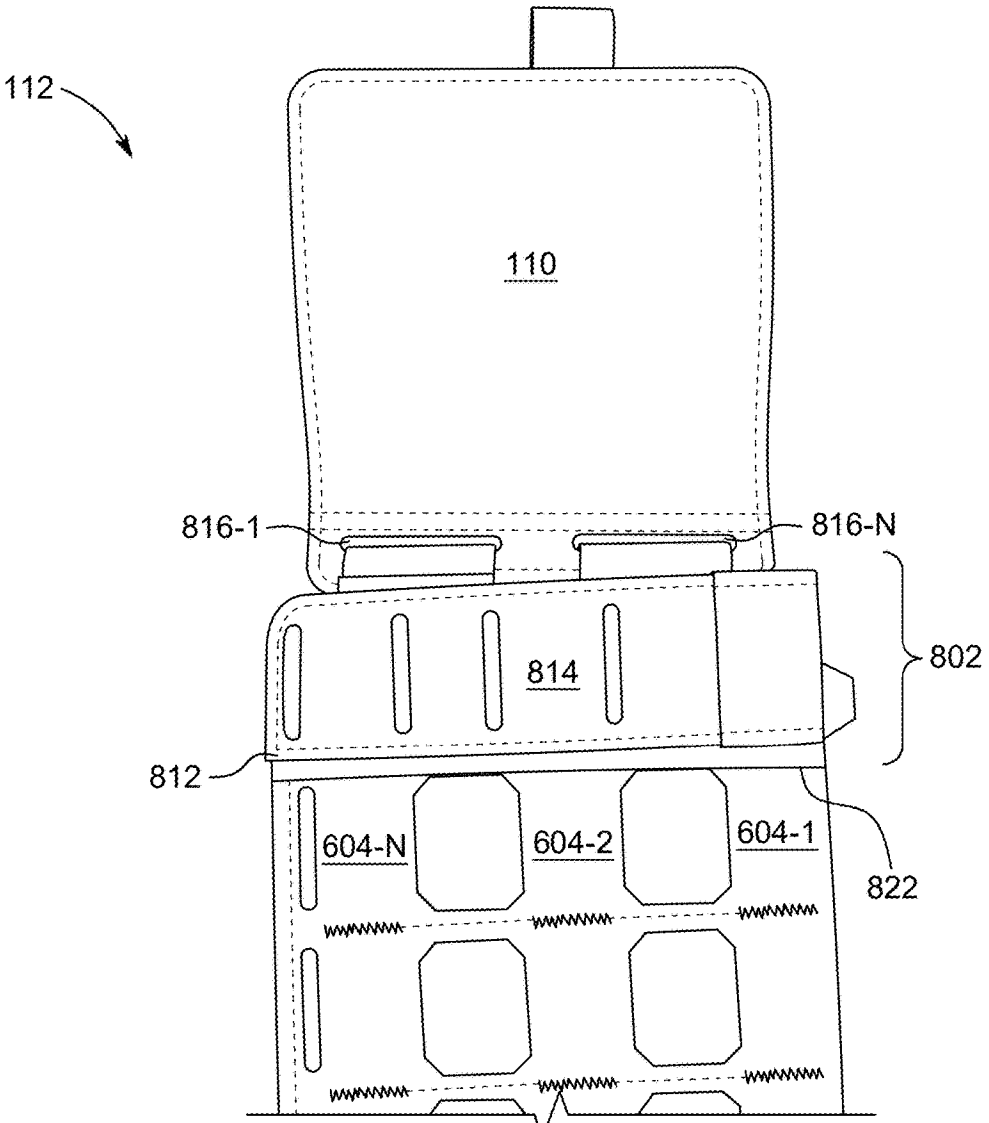
Figure 8J:
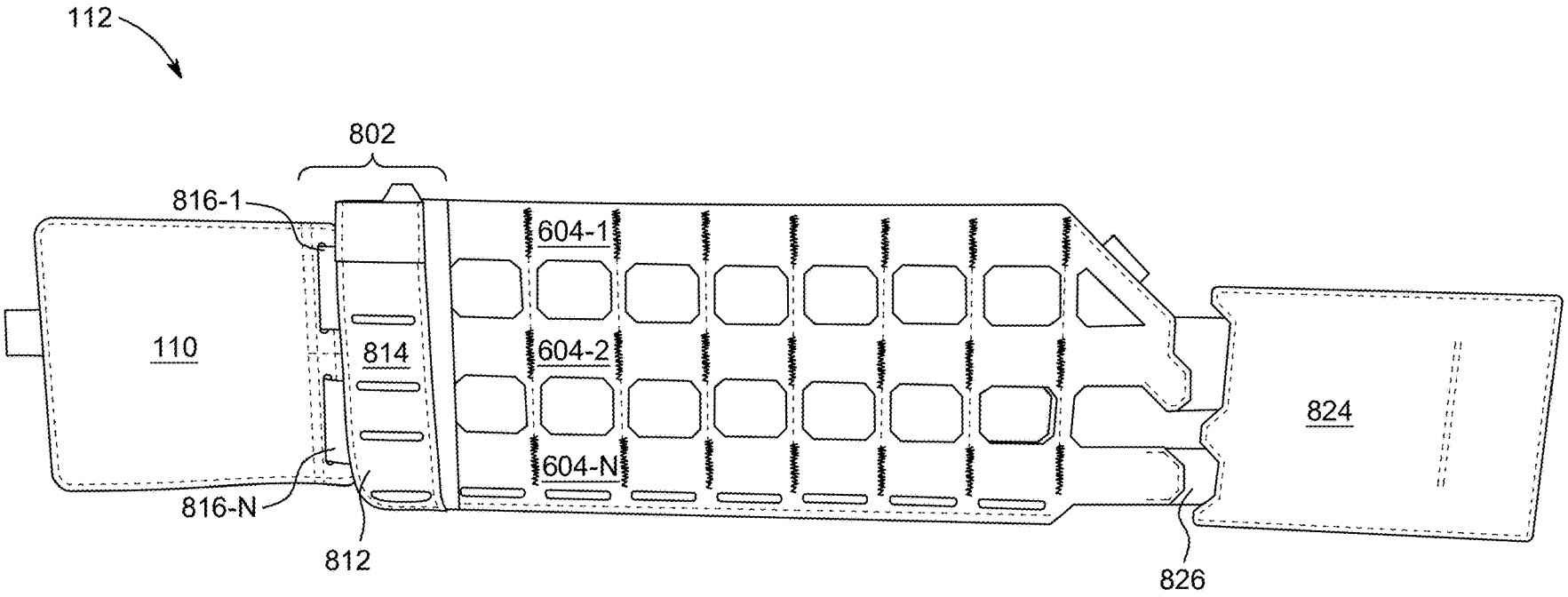
Figure 8K:
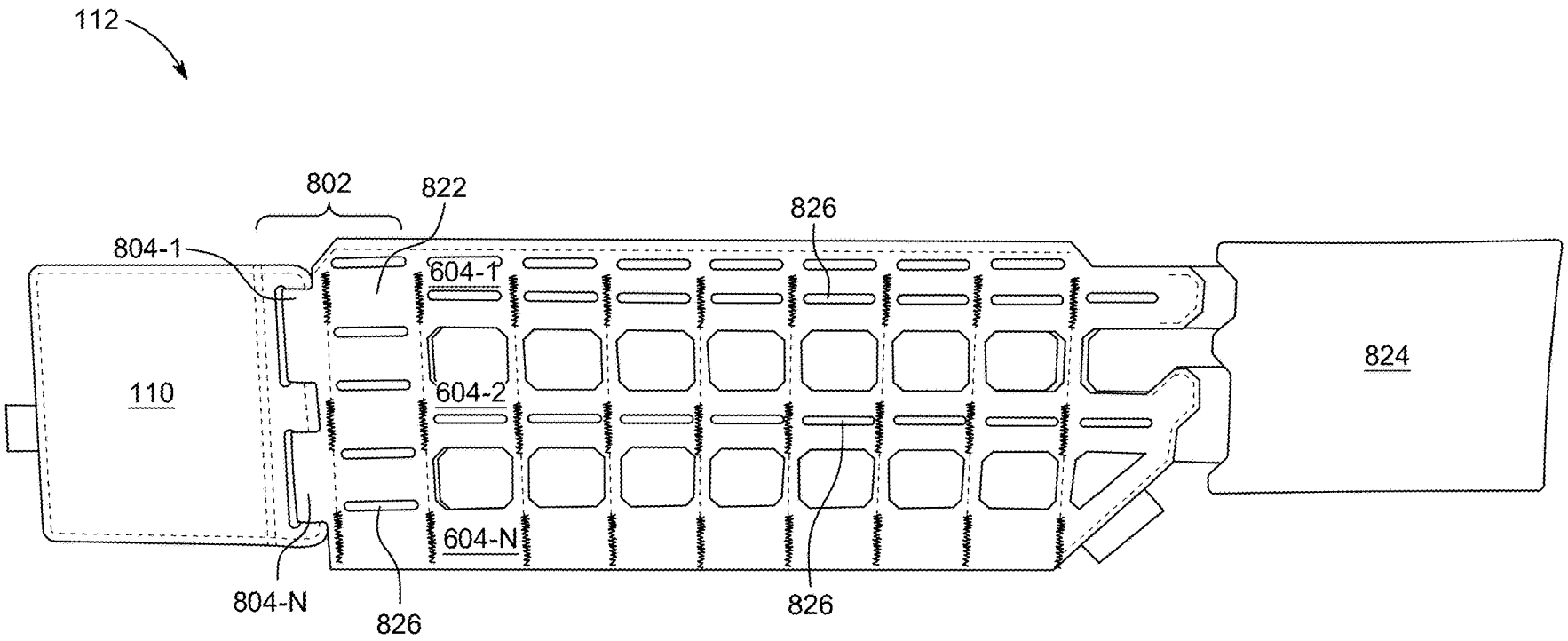

FIGS. 7A-7B illustrate an example of an expansion joint 610 of first cummerbund adjustment mechanism, in accordance with one or more embodiments described herein. Expansion joint 610 may be located within an expansion joint sheath of a cummerbund as outlined with respect to FIGS. 6A-6C. As outlined, each of the cummerbund straps 604 may include a corresponding expansion joint. In FIG. 7A, expansion joint 610 is illustrated in its non-expanded configuration. Conversely, in FIG. 7B, expansion joint 610 is illustrated in an expanded configuration under load 616.

Expansion joint 610 may be a connection point or joint between the first portion 612 and the second portion 614 of a respective cummerbund strap. The expansion joint 610 may include an elastic component 608 and/or a limiting component 606. The elastic component 608 may be an elastic band, webbing, tape, etc. material. Elastic component 608 may be configured to elastically lengthen under a load (e.g., load 616) and return to its original length once the load is removed. Since elastic component 608 serves as a connection point or joint between the first portion 612 and the second portion 614 of a respective cummerbund strap, when it lengthens under load the wearable length of that cummerbund strap is thereby lengthened until the load is removed.

The limiting component 606 may be a non- or less-elastic band, webbing, tape, etc. material. For instance, the limiting component 606 may be a high-tensile strength material such a nylon webbing or tape. In some instances, the limiting component 606 may be the same material as the material of cummerbund strap 604. The limiting component 606 may be less elastic and/or have a significantly higher modulus of elasticity than the elastic component 608 such that it will not appreciably lengthen under the load (e.g., load 616) causing the lengthening of elastic component 608.

The limiting component 606 may be attached (e.g., stitched) to and/or overlay the elastic component 608. For example, at first end 620 a limiting component 606 may be folded over on itself to form a double edge which may be layered on top of an end of the elastic component 608 and a cummerbund strap 604. At second end 618 a limiting component 606 may be folded over on itself to form a double edge with an end of the elastic component 608 being sandwiched within the fold over and both being attached to the cummerbund strap 604.

The limiting component 606 may be configured to be a longer length than the length of the elastic component 608 when it is not under a load (e.g., not stretched), causing the limiting component 606 to have slack along its length when not experiencing load 616. Therefore, when load 616 is applied to cummerbund straps 604, the elastic component 608 will lengthen (e.g., thereby lengthening the wearable length of the cummerbund). In response to this lengthening the slack will be taken out of limiting component 606 as its two ends are stretched apart by virtue of their connection to the ends of the elastic component 608. Eventually, all the slack may be taken out of the limiting component 606 and it may be taut. At this point, lengthening of the elastic component 608 and/or the wearable length of the cummerbund may be arrested, and further lengthening may be prevented since the limiting component 606 resists further stretching. Hence, even though the elastic component 608 alone could continue to lengthen under load 616, the limiting component 606 prevents this by resisting load 616.

In this manner, limiting component 606 may protect the elastic component 608 by preventing it from damage or failure caused by over-stretching. In addition, limiting component 606 may increase the strength and longevity of the cummerbund. The action afforded by this configuration may enable the first cummerbund adjustment mechanism to behave as a shock absorber mechanism facilitating dynamic expansion and contraction of the cummerbund.

FIGS. 8A-8K illustrate examples of the second cummerbund adjustment mechanism 112 progressing through various stages of engagement (e.g., pre-engagement in FIG. 8A-8C, partial engagement in FIG. 8D-8F, and full engagement in FIG. 8G-8K) with a reconfigurable panel attachment portion 110, in accordance with one or more embodiments described herein. Second cummerbund adjustment mechanism 112 may be used to swap out and/or switch between any of a plurality of panel attachment mechanisms to achiever a wearer's preferred configuration and fit for a tactical vest. For example, a plurality of different cummerbund closure mechanisms exist such as hook and loop fastener panels, buckles, quick release tubes, hooks, etc.

A particular wearer may prefer a certain closure mechanism because it is more familiar, provides them with a better fit, provides them with the ability to have their tactical vest quickly removed for convenience or safety, etc. In addition, at times the closure mechanism already mounted to the tactical vest may become damaged or inoperable. Unfortunately, with conventional cummerbund closure mechanisms, both of these instances require a wearer to doff the cummerbund being replaced and/or tactical vest, remove any equipment from the cummerbund being replaced, install the preferred and/or operational cummerbund, install and configure any equipment removed from the cummerbund being replaced on the newly installed preferred and/or operational cummerbund, and/or make any fit adjustments to the newly installed preferred and/or operational cummerbund. This can be a cumbersome, frustrating, and/or dangerous endeavor in many circumstances.

In contrast, second cummerbund adjustment mechanism 112 facilitates swapping out and/or switching between any of a plurality of panel attachment mechanisms 'on-the-fly,' without replacing the entire cummerbund, and/or without involving the removal, reinstallation, and/or reconfiguration of equipment on the cummerbund. Instead, the second cummerbund adjustment mechanism 112 allows a wearer to quickly switch out the panel attachment mechanism alone without disturbing the other components of the cummerbund. For example, the second cummerbund adjustment mechanism 112 may be utilized to switch out the reconfigurable panel attachment portion 110 for another without involving removal, reconfiguration, reattachment, and/or manipulation of a rear panel attachment portion 824 (e.g., which may have any number of configurations such as a pincer buckle 602 illustrated in FIGS. 6*a*-6C) that remains releasably engaged with a rear panel of the tactical vest.

Second cummerbund adjustment mechanism 112 may facilitate this swapping using an attachment mechanism adapter 802 configured to releasably engage with a range of reconfigurable panel attachment portions (e.g., reconfigurable panel attachment portion 110). The diverse range of reconfigurable panel attachment portions may have an equally diverse range of panel attachment mechanism configurations (e.g., hook and loop fastener panels, buckles, quick release tubes, hooks, etc.) for attaching to a tactical vest panel and/or attaching to a complementary attachment mechanism attached to the tactical vest panel. That is, attachment mechanism adapter 802 may function as a generic adapter capable of securely engaging any type of reconfigurable panel attachment portion 110 to a cummerbund regardless of its particular panel attachment mechanism configuration.

For example, an attachment mechanism adapter 802 may include a locking flap. The locking flap may be made up of a bottom flap 822 and a top flap 812. Cummerbund straps 604 may be attached (e.g., stitched) to the bottom flap 822. For instance, cummerbund straps 604 may be attached to an external face of the bottom flap 822. An internal face 818 of the bottom flap 822 may include region (e.g., an attached panel) of hook and loop fastener. An internal face 820 of top flap 812 may include a region (e.g., an attached panel) of hook and loop fastener that is complementary to the region on the internal face 818 of the bottom flap 822.

In various embodiments, such as those illustrated in FIGS. 8C, 8F, 81, 8J, and 8K, second cummerbund adjustment mechanism 112 may be integrated into a skeletonized, semi-rigid, and/or stiffened cummerbund. A semi-rigid and/or stiffened cummerbund may be more resistance to sag and/or separation when bulky equipment is attached.

In these types of semi-rigid and/or stiffened cummerbunds, a portion (e.g., all, only some, only first strap 604-2 and second strap 604-N, etc.) of cummerbund straps 604 may be reinforced or stiffened (e.g., with a semi-rigid material 826 such as a polymer, carbon fiber, plastic, etc. fixed between two fabric-like layers of nylon webbing or tape). In addition, in such embodiments the bottom flap 822 may also be reinforced or stiffened (e.g., with a semi-rigid material 826 fixed between an internal face 818 of bottom flap 822 and a fabric-like layer of nylon webbing or tape making up a bottom and/or external face of bottom flap 822).

Bottom flap 822 may include one or more extensions that form engagement straps 804 (e.g., 804-1 . . . 804-N). Each engagement strap may be a thirty-eight-millimeter-wide extension of the bottom flap 822. The internal faces 806 (e.g., 806-1 . . . 806-N) of the engagement straps 804 may include a region (e.g., an attached panel) of hook and loop fastener that is complementary to the region on the internal face 818 of the bottom flap 822. External faces 808 (e.g., 808-1 . . . 808-N) of engagement straps 804 may include a region (e.g., an attached panel) of hook and loop fastener that is complementary to the region on the internal face 820 of the bottom flap 822 of top flap 812.

Each type of reconfigurable panel attachment portion 110, regardless of its particular panel attachment mechanisms, may include one or more opening such as adapter mating openings 816 (e.g., 816-1 . . . 816-N). Each of the adapter mating openings 816 may be a slit dimensioned (e.g., as a thirty-eight to forty-millimeter slot) to accommodate passage and/or retention of a corresponding engagement strap passed therethrough. Each of the engagement straps 804 may be configured to be looped through a corresponding one of the adapter mating openings 816.

Once looped through the adapter mating openings 816, the engagement straps 804 may be folded over having their internal face releasably attached to the internal face 818 of bottom flap 822. Then, the top flap 812 of the locking flap may be folded over so that internal face 820 of top flap 812 is releasably attached to the external faces 808 of engagement straps 804 and/or to any uncovered portions of the internal face 818 of bottom flap 822. In this fully engaged configuration, the reconfigurable panel attachment portion 110 may be securely releasably engaged to the cummerbund through attachment mechanism adapter 802. This releasable attachment can be reversed to release the reconfigurable panel attachment portion 110 and quickly swap it out by repeating the process with another reconfigurable panel attachment portion 110.

Either or both of external face 814 of top flap 812 and/or the external face of bottom flap 822 may include an attachment mechanism such as hook and loop fasteners, MOLLE, buckles, hooks, snaps, quick release mechanisms, etc. that may be used to attach various tactical accessories (e.g., patches, holsters, pouches, medical kits, radios, wires, drink bladders, tools, etc.). As such, the portions of a cummerbund where tactical accessories may be mounted are not removed from the cummerbund when swapping between reconfigurable panel attachment portions. Therefore, there is no need to reconfigure, remove, reinstall, etc. equipment when performing these swaps. Further, a tactical vest and/or cummerbund does not need to be doffed in order to perform these swaps. In various embodiments, such as when integrated with skeletonized, semi-rigid, and/or semi-stiffened cummerbunds, the bottom flap 822 may act as a stiffened platform having semi-rigid or stiffened characteristics relative to the top flap 812 since the bottom flap 822 may be mounted on top of a semi-rigid material 826.

The mechanisms described herein, therefore, introduce an adjustable fit tactical vest and/or an apparatus and system for adjusting the fit of a tactical vest in a manner that achieves a rapid, repeatable, and symmetric fittings. Further, the described configurations minimize the amount of time and instances that a wearer must remove his or her tactical vest in order to achieve this fit. Furthermore, the described structures combine to offer a wearer a dynamic cummerbund portion of a tactical vest that can adjust to the wearer's movement via sheathed shock absorber-like components and adapter mechanisms that facilitate on-the-fly panel attachment mechanism swaps outs.

According to the embodiments herein, an illustrative system for fit adjustment of a tactical vest may comprise: shoulder straps configured to have independently adjustable wearable lengths and to be releasably attachable to a face of a chest panel of the tactical vest or a back panel of the tactical vest at any of a plurality of potential shoulder strap attachment positions; and a set of reference markings on the face of the chest panel or the back panel, each reference marking of the set of reference markings indicating a respective potential shoulder strap attachment position of the plurality of potential shoulder strap attachment positions, wherein the set of reference markings is configured such that releasably attaching each of the shoulder straps to the face of the chest panel of the tactical vest or the back panel of the tactical vest so that corresponding portions of the shoulder straps align with equivalent reference markings causes the shoulder straps to have an equivalent wearable length.

In one embodiment, each of the shoulder straps includes a slotted channel through which a panel strap attached to the chest panel of the tactical vest or the back panel of the tactical vest can be engaged at any of a plurality of potential panel strap attachment positions to provide an adjustment to a hanging angle of the chest panel of the tactical vest or the back panel of the tactical vest. In one embodiment, each slotted channel is marked with a secondary set of reference markings that indicate a plurality of potential panel strap attachment positions that are matched to the plurality of potential shoulder strap attachment positions. In one embodiment, the system for fit adjustment of a tactical vest further comprising a cummerbund configured to couple the chest panel of the tactical vest to the back panel of the tactical vest.

In one embodiment, the cummerbund includes an expandable joint housed within a sheath located between an attachment point to the chest panel of the tactical vest and an attachment point to the back panel of the tactical vest. In one embodiment, the expandable joint comprises: an expansion strap bridging adjacent portions of the cummerbund and being configured to elastically expand to increase a wearable length of the cummerbund under tension; and a limiting strap coupled to the expansion strap and configured to limit an amount of expansion by the expansion strap under tension. In one embodiment, an exterior of the sheath is configured as an equipment bearing side panel of the tactical vest equipped with equipment attachment points. In one embodiment, the cummerbund includes a reconfigurable panel attachment portion that can be switched among a plurality of panel attachment mechanisms. In one embodiment, the cummerbund includes an attachment mechanism adapter comprising an engagement strap configured to be looped through a corresponding slot in a panel attachment mechanism and releasably captured within a locking flap attached to the cummerbund to releasably secure the panel attachment mechanism to the cummerbund.

According to the embodiments herein, an illustrative tactical vest fit adjustment apparatus may comprise: a first panel including a set of panel reference markings to identify a shoulder strap attachment position among a plurality of potential shoulder strap attachment positions where a shoulder strap is releasably attached to a face of the first panel; and shoulder straps configured to couple the first panel to a second panel across shoulders of a wearer, wherein each of the shoulder straps is configured to have an independently adjustable wearable length dictated by its shoulder strap attachment position and wherein the shoulder straps are configured to have a same wearable length when the shoulder straps are releasably attached to the first panel in alignment with equivalent reference marking of the set of panel reference markings.

In one embodiment, the tactical vest fit adjustment apparatus further comprising a cummerbund configured to couple the first panel to the second panel across sides of the wearer, wherein the cummerbund includes an attachment mechanism adapter configured to releasably capture each of a plurality of structurally distinct panel attachment mechanisms to attach the cummerbund to the first panel. In one embodiment, the tactical vest fit adjustment apparatus further comprising a cummerbund configured to couple the first panel to the second panel across sides of the wearer, wherein the cummerbund includes an expandable joint housed within a sheath configured to be positioned along a wearer's side. In one embodiment, the tactical vest fit adjustment apparatus further comprising further comprising a panel strap attached to an opposing face of the first panel and configured to releasably engage with a corresponding shoulder strap.

In one embodiment, each of the shoulder straps includes a slotted channel configured to receive the panel strap laced through slots marked with a secondary set of reference markings that indicate their correspondence to each of the plurality of potential shoulder strap attachment positions. In one embodiment, each of the shoulder straps includes a locking channel configured to capture and releasably lock a corresponding panel strap attached to the first panel and a corresponding panel strap attached to the second panel to that strap. In one embodiment, the locking channel includes pass-through slots to accommodate auxiliary equipment within the locking channel.

According to the embodiments herein, an illustrative tactical vest may comprise: a chest panel comprising an external face and an internal face and having a set of reference markings indicating respective strap attachment positions on the internal face; a back panel; a first strap attached to the chest panel and having a first releasable attachment portion configured to engage a corresponding portion of a third strap; a second strap attached to the back panel and having a second releasable attachment portion configured to engage a corresponding portion of the third strap; the third strap attached to the back panel and having: a chest panel engaging portion configured to releasably attach to the internal face of the chest panel; and a slotted channel portion including a set of channel reference markings corresponding to the set of reference markings indicating the respective strap attachment positions on the internal face of the chest panel, the slotted channel portion configured to accept the first strap through a slot indicated by a channel reference marking as corresponding to a strap attachment position on the internal face where the third strap is releasably attached; and a cummerbund configured to couple the chest panel to the back panel.

In one embodiment, the cummerbund is elastically expandable at an expandable joint located within a sheath located along a portion of the cummerbund between an attachment point to the chest panel and an attachment point to the back panel. In one embodiment, the cummerbund includes a panel attachment mechanism capture strap configured to be passed through coinciding slits in any of a plurality of different panel attachment mechanisms and folded back on itself to secure each plurality of different panel attachment mechanisms to an end of the cummerbund. In one embodiment, the third strap includes a padded portion opposite the slotted channel portion and configured to contact the shoulder of a wearer.

According to the embodiments herein, an illustrative tactical cummerbund adjustment apparatus may comprise: cummerbund straps configured to span between a first panel of a tactical vest to a second panel of the tactical vest across sides of a wearer; and an attachment mechanism adapter attached to the cummerbund straps and including an engagement strap configured to be looped through a corresponding slot in a panel attachment mechanism and releasably captured within a locking flap of the attachment mechanism adapter.

In one embodiment, the locking flap includes a top flap and a bottom flap and wherein the engagement strap is releasably captured within the locking flap when sandwiched between the top flap and the bottom flap. In one embodiment, an internal face of a top flap of the locking flap includes a first fastener region and an internal face of a bottom flap of the locking flap includes a second fastener region and wherein the first fastener region and the second fastener region are complementary. In one embodiment, a first face of the engagement strap includes a third fastener region and a second face of the engagement strap, opposite the first face, includes a fourth fastener region and wherein the third fastener region is complementary to the first fastener region on the internal face of the top flap and the fourth fastener region is complementary to the second fastener region on the internal face of the bottom flap.

The foregoing description has been directed to specific embodiments. It will be apparent, however, that other variations and modifications may be made to the described embodiments, with the attainment of some or all of their advantages. The construction and arrangement of the adjustable fit tactical vest as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.).

For example, the position of elements may be reversed or otherwise varied, and the nature or number of discrete elements or positions may be altered or varied. Accordingly, all such modifications are intended to be included within the scope of the present disclosure. Other substitutions, modifications, changes, and omissions may be made in the design, operating conditions and arrangement of the exemplary embodiments without departing from the scope of the present disclosure.

Accordingly, this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. A system for fit adjustment of a tactical vest comprising:

shoulder straps configured to have independently adjustable wearable lengths and to be releasably attachable to a face of a chest panel of the tactical vest or a back panel of the tactical vest at any of a plurality of potential shoulder strap attachment positions, wherein each of the shoulder straps includes a slotted channel through which a panel strap attached to the chest panel of the tactical vest or the back panel of the tactical vest can be engaged at any of the plurality of potential panel strap attachment positions to provide an adjustment to a hanging angle of the chest panel of the tactical vest or the back panel of the tactical vest; and a set of reference markings on the face of the chest panel or the back panel, each reference marking of the set of reference markings indicating a respective potential shoulder strap attachment position of the plurality of potential shoulder strap attachment positions, wherein the set of reference markings is configured such that releasably attaching each of the shoulder straps to the face of the chest panel of the tactical vest or the back panel of the tactical vest so that corresponding portions of the shoulder straps align with equivalent reference markings causes the shoulder straps to have an equivalent wearable length.

2. The system of claim 1, wherein each slotted channel is marked with a secondary set of reference markings that indicate a plurality of potential panel strap attachment positions that are matched to the plurality of potential shoulder strap attachment positions.

3. The system of claim 1, further comprising a cummerbund configured to couple the chest panel of the tactical vest to the back panel of the tactical vest.

4. The system of claim 3, wherein the cummerbund includes an expandable joint housed within a sheath located between an attachment point to the chest panel of the tactical vest and an attachment point to the back panel of the tactical vest.

5. The system of claim 4, wherein the expandable joint comprises:

an expansion strap bridging adjacent portions of the cummerbund and being configured to elastically expand to increase a wearable length of the cummerbund under tension; and a limiting strap coupled to the expansion strap and configured to limit an amount of expansion by the expansion strap under tension.

6. The system of claim 4, wherein an exterior of the sheath is configured as an equipment bearing side panel of the tactical vest equipped with equipment attachment points.

7. The system of claim 3, wherein the cummerbund includes a reconfigurable panel attachment portion that can be switched among a plurality of panel attachment mechanisms.

8. The system of claim 3, wherein the cummerbund includes an attachment mechanism adapter comprising an engagement strap configured to be looped through a corresponding slot in a panel attachment mechanism and releasably captured within a locking flap attached to the cummerbund to releasably secure the panel attachment mechanism to the cummerbund.

9. A tactical vest fit adjustment apparatus comprising:

a first panel including a set of panel reference markings to identify a shoulder strap attachment position among a plurality of potential shoulder strap attachment positions where a shoulder strap is releasably attached to a face of the first panel;

a panel strap attached to an opposing face of the first panel and configured to releasably engage with a corresponding shoulder strap;

shoulder straps configured to couple the first panel to a second panel across shoulders of a wearer, wherein:

each of the shoulder straps is configured to have an independently adjustable wearable length dictated by its shoulder strap attachment position;

the shoulder straps are configured to have a same wearable length when the shoulder straps are releasably attached to the first panel in alignment with equivalent reference marking of the set of panel reference markings; and each of the shoulder straps includes a slotted channel configured to receive the panel strap laced through slots marked with a secondary set of reference markings that indicate their correspondence to each of the plurality of potential shoulder strap attachment positions.

10. The tactical vest fit adjustment apparatus of claim 9, further comprising a cummerbund configured to couple the first panel to the second panel across sides of the wearer, wherein the cummerbund includes an attachment mechanism adapter configured to releasably capture each of a plurality of structurally distinct panel attachment mechanisms to attach the cummerbund to the first panel.

11. The tactical vest fit adjustment apparatus as in claim 9, further comprising a cummerbund configured to couple the first panel to the second panel across sides of the wearer, wherein the cummerbund includes an expandable joint housed within a sheath configured to be positioned along a wearer's side.

12. The tactical vest fit adjustment apparatus as in claim 9, wherein each of the shoulder straps includes a locking channel configured to capture and releasably lock a corresponding panel strap attached to the first panel and a corresponding panel strap attached to the second panel to that strap.

13. The tactical vest fit adjustment apparatus as in claim 12, wherein the locking channel includes pass-through slots to accommodate auxiliary equipment within the locking channel.

* * * * *